US009500980B2

(12) United States Patent
Seki

(10) Patent No.: US 9,500,980 B2
(45) Date of Patent: Nov. 22, 2016

(54) IMAGE FORMING APPARATUS OF ELECTROPHOTOGRAPHIC SYSTEM

(71) Applicant: CANON KABUSHIKI KAISHA, Tokyo (JP)

(72) Inventor: Yuichi Seki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/710,866

(22) Filed: May 13, 2015

(65) Prior Publication Data

US 2015/0338766 A1 Nov. 26, 2015

(30) Foreign Application Priority Data

May 23, 2014 (JP) ..... 2014-107268

(51) Int. Cl.
*G03G 15/043* (2006.01)
*B41J 2/47* (2006.01)

(52) U.S. Cl.
CPC ..... *G03G 15/043* (2013.01); *B41J 2/47* (2013.01)

(58) Field of Classification Search
CPC ..... B41J 2/385; B41J 2/435; B41J 2/47; H05B 37/02; G03G 15/043
See application file for complete search history.

(56) References Cited

U.S. PATENT DOCUMENTS

2008/0084469 A1* 4/2008 Okada ..... G06K 15/1209 347/236
2012/0300009 A1* 11/2012 Toyoizumi ..... B41J 2/471 347/118

FOREIGN PATENT DOCUMENTS

JP 2000351232 A 12/2000

* cited by examiner

*Primary Examiner* — Sarah Al Hashimi
(74) *Attorney, Agent, or Firm* — Rossi, Kimms & McDowell LLP

(57) ABSTRACT

An image forming apparatus capable of controlling an amount of light beam to be a target value even when an emission characteristic of a light source varies. A photosensitive member is exposed to the light beam emitted form a light source. A light receiving element receives the light beam. Voltage for prescribing the driving current is set in a voltage setting unit. A voltage control unit controls the voltage so that the light amount of the light beam received by the light receiving element becomes a target light amount. A determination unit determines a correction parameter for correcting the voltage based on at least the voltage set in the voltage setting unit. A correction unit corrects the voltage set in the voltage setting unit with the correction parameter. A current supply unit supplies a driving current corresponding to the corrected voltage to the light source based on image data.

9 Claims, 22 Drawing Sheets

IMAGE FORMING APPARATUS OF ELECTROPHOTOGRAPHIC SYSTEM

BACKGROUND OF THE INVENTION

1. Field of the Invention

The present invention relates to an image forming apparatus of an electrophotographic system and, in particular, to a technique for controlling a light amount of a light beam emitted from a light source.

2. Description of the Related Art

The image forming apparatus of the electrophotographic system is provided with a light source (for example, an LED, a semiconductor laser) for exposing a photosensitive member. The image forming apparatus controls a driving current supplied to the light source so that an output image is formed with a desired density.

Japanese Laid-Open Patent Publication (Kokai) No. 2000-351232 (JP 2000-351232A) discloses a technique that stores a driving-current/light-amount characteristic (a light-amount/current characteristic curve) to a nonvolatile memory for every LED and controls a light amount of a light beam emitted from each LED on the basis of the driving-current/light-amount characteristic in order to correct variation among characteristics of a plurality of LEDs and characteristics of light-amount control units.

However, the technique of the above-mentioned publication cannot cope with a change of the driving-current/light-amount characteristic due to a temperature change around the light source, a temperature change of the light source due to heat generation of the light source itself, or aging degradation of the light source that is caused by repeating emissions.

FIG. 21 is a graph showing examples of driving-current/light-amount characteristics of a semiconductor laser.

In FIG. 21, a solid line indicates the driving-current/light-amount characteristic in a case where the ambient temperature of the light source is 25° C., and a broken line indicates the driving-current/light-amount characteristic in a case where the ambient temperature of the light source is 50° C. As shown in FIG. 21, the light amount of the light beam emitted from the light source is 1.00 mW in a case where the driving current supplied to the light source is 1.84 mA at the ambient temperature of 25° C. On the other hand, the light amount of the light beam emitted from the light source is 0.86 mW in a case where the driving current supplied to the light source is 1.84 mA at the ambient temperature of 50° C. Thus, the driving-current/light-amount characteristic varies due to the change of the ambient temperature of the light source, etc.

SUMMARY OF THE INVENTION

The present invention provides an image forming apparatus that is capable of controlling a light amount of a light beam to which a photosensitive member is exposed to be a target light amount even when an emission characteristic of a light source varies.

Accordingly, a first aspect of the present invention provides an image forming apparatus including a light source configured to emit a light beam of which light amount corresponds to a driving current supplied, a photosensitive member configured to be exposed to the light beam emitted from the light source, a light receiving element configured to receive the light beam emitted from the light source, a voltage setting unit in which a voltage for prescribing the driving current is set, a voltage control unit configured to control the voltage set in the voltage setting unit so that the light amount of the light beam received by the light receiving element becomes a target light amount, a determination unit configured to determine a correction parameter for correcting the voltage set in the voltage setting unit based on at least the voltage set in the voltage setting unit, a correction unit configured to correct the voltage set in the voltage setting unit with the correction parameter determined by the determination unit, and a current supply unit configured to supply the driving current corresponding to the voltage corrected by the correction unit to the light source based on image data.

According to the present invention, the light amount of the light beam to which the photosensitive member is exposed is controlled to be the target light amount by switching the correction parameter to the reference light amount according to the varying emission characteristic of the light source.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings. First, an image processing apparatus according to a first embodiment will be described.

Figure 1:
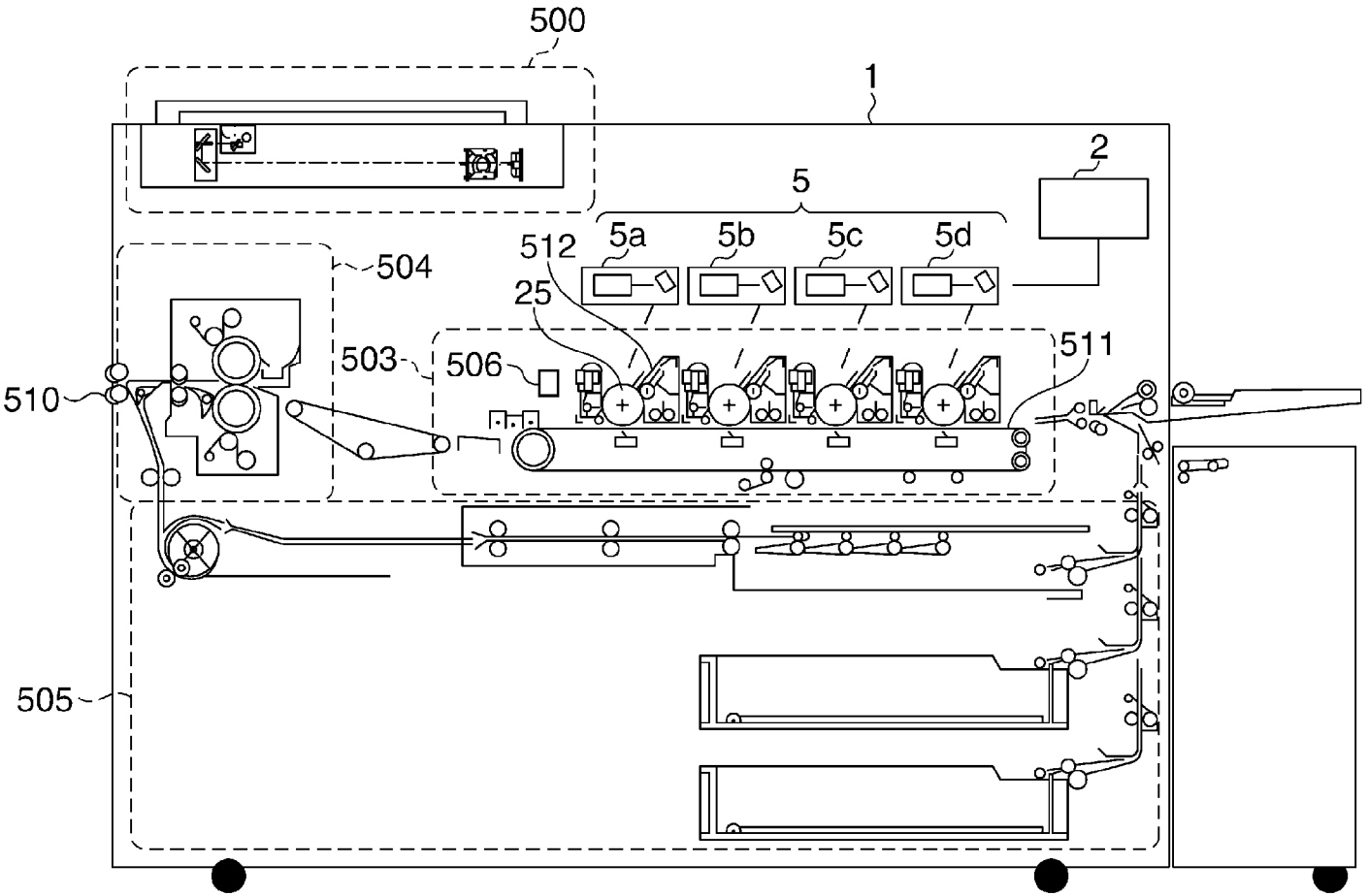
FIG. 1 is a sectional view schematically showing a configuration of an image forming apparatus according to a first embodiment of the present invention.

FIG. 1 is a sectional view schematically showing the image forming apparatus 1. The image forming apparatus 1 includes a reader-scanner section 500, an image control unit (a determination unit) 2, an exposure section 5, an image forming section 503, a fixing section 504, and a sheet feeding section 505.

The reader-scanner section 500 irradiates an original placed on a tray with a light, and reads an original image optically by receiving a reflected light from the original.

The image control unit 2 controls light amounts of light beams (laser beams) emitted from the exposure section 5, and generates image data by converting the original image read with the reader-scanner section 500 into electrical signals. The exposure section 5 includes optical scanning devices 5*a*, 5*b*, 5*c*, and 5*d* that form latent images on photosensitive drums 25 as photosensitive members by emitting lights according to the above-mentioned image data.

The image forming section 503 includes the photosensitive drums 25, development units 512, a photo sensor 506, and a conveying belt 511 that conveys a recording sheet. The combination of the photosensitive drum 25 and the development unit 512 is disposed corresponding to each of the optical scanning devices 5*a*, 5*b*, 5*c*, and 5*d*. The combinations respectively generate cyan (C), magenta (M), yellow (Y), and black (K) images.

In the image forming section 503, the surfaces of the photosensitive drums 25 are charged by electrostatic chargers. The surfaces of the photosensitive drums 25 that are charged by the electrostatic chargers are exposed to the light beams emitted from the optical scanning devices 5*a*, 5*b*, 5*c*, and 5*d* respectively, which forms electrostatic latent images on the surfaces. The development units 512 develop the electrostatic latent images formed on the photosensitive drums 25 using toner. The image forming section 503 transfers the toner images developed with the development units 512 onto a sheet (a recording medium) conveyed with the conveying belt 511. The image forming section 503 forms a magenta (M) image, a cyan (C) image, and a black (K) image in order after the lapse of a predetermined period from the start of formation of a yellow (Y) image. Accordingly, the image forming section 503 transfers a full color toner image on the sheet conveyed with the conveying belt 511.

The fixing section 504 has a heat source, such as a halogen heater, and fixes the above-mentioned full color toner image transferred onto the sheet to the sheet concerned by dissolving the toner on the sheet with heat and pressure.

In the image forming apparatus 1, the image forming section 503 forms a density-detection toner pattern (a density-detection toner image) on the conveying belt 511 according to an instruction from a CPU (not shown). A density-detection toner pattern is formed on a space between two sheets that are continuously conveyed with the conveying belt 511. A density-detection toner pattern may be formed whenever an image is formed on one sheet, or whenever images are formed on a plurality of sheets.

The photo sensor (a detection unit) 506 irradiates a density-detection toner pattern with light, and detects reflected light from the toner pattern. The photo sensor 506 transmits a detection result (density information about the density-detection toner pattern) to the CPU. The CPU transmits a gain instruction signal mentioned later to the gain correction unit 53 mentioned later on the basis of the detection result concerned. The gain instruction signal is used to reduce density fluctuation of an output image owing to a change of sensitivity of the photosensitive drum 25 to the light beam or a temperature change around the image forming apparatus 1. The CPU controls a driving current $I_{sw}$ based on the gain instruction signal so that an output image is formed at desired density.

The density-detection toner pattern formed on the conveying belt 511 is removed from the conveying belt 511 by the cleaning blade (not shown).

Figure 2:
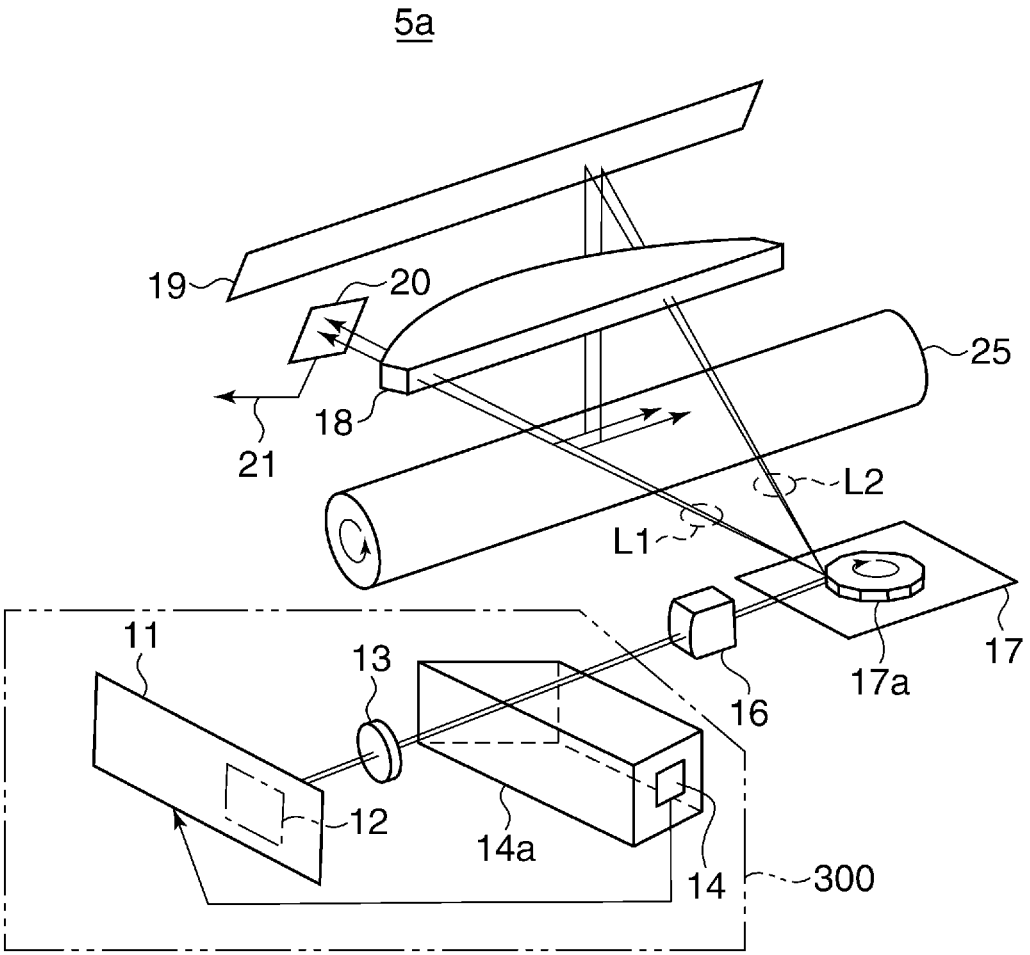
FIG. 2 is a perspective view showing a configuration of an exposure section of the image forming apparatus shown in FIG. 1.

FIG. 2 is a perspective view showing the configuration of the exposure section 5 of the image forming apparatus 1 shown in FIG. 1.

Since all the optical scanning devices 5*a*, 5*b*, 5*c*, and 5*d* have the same configurations, only the optical scanning device 5*a* will be described as a representative in FIG. 2.

The optical scanning device 5*a* includes the laser driving unit 11, the semiconductor laser (light source) 12, a collimating lens 13, a beam splitter 14*a*, a light receiving element (hereinafter referred to as a PD (Photo Detector)) 14 that detects a beam split by the beam splitter 14*a*, a cylindrical lens 16, a scanner unit 17, a polygon mirror 17*a*, an fθ lens 18, a mirror 19, and a beam detection sensor (Beam Detector, hereinafter referred to as a BD) 20.

The laser beams L1 and L2 (light beams) emitted from the semiconductor laser 12 according to control signals from the laser driving unit 11 transmit the collimating lens 13 and the cylindrical lens 16, and arrive at the polygon mirror 17*a* rotated by the scanner unit 17 having a scanner motor. The polygon mirror 17*a* deflects the laser beams L1 and L2 concerned so that the laser beams L1 and L2 scan the photosensitive drum 25.

The laser beams L1 and L2 deflected by the polygon mirror 17*a* pass the fθ lens 18, and scan the photosensitive drum 25 at approximately constant speed. The laser beam L1 is detected by the BD 20 in a non-image region, and the BD 20 outputs a beam detection signal (hereinafter referred to as a "BD signal") 21 that determines the writing start point in an image region.

The image control unit 2, the laser driving unit 11, the semiconductor laser 12, and the PD 14 constitutes the laser control system 300 that will be hereinafter described in detail.

Figure 3A:
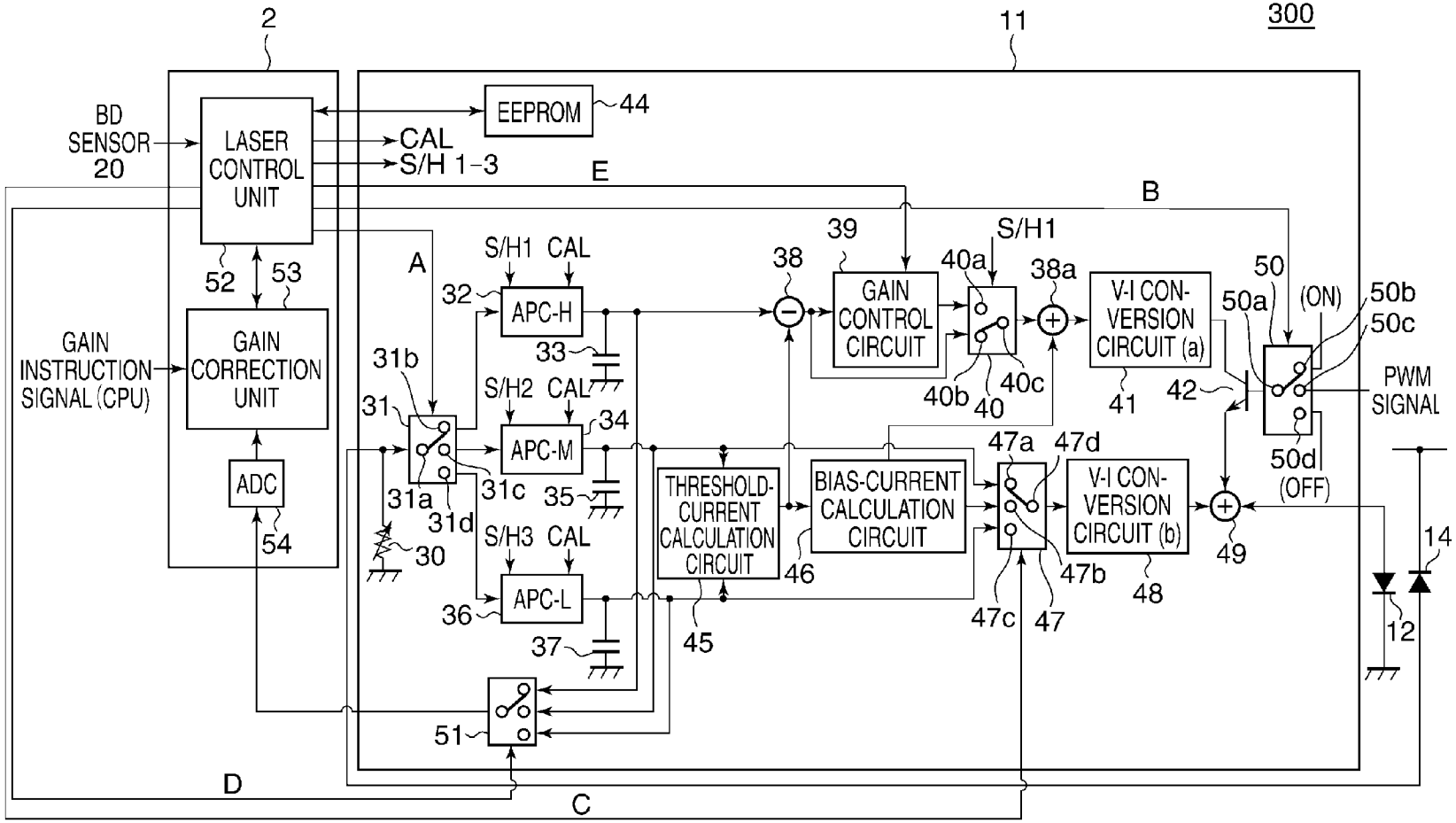
FIG. 3A is a block diagram schematically showing a configuration of a laser control system shown in FIG. 2.

FIG. 3A is a block diagram schematically showing the configuration of the laser control system 300 shown in FIG. 2.

As shown in FIG. 3A, the image control unit 2 includes a laser control unit 52, a gain correction unit 53, and an AD converter (hereinafter referred to as an "ADC") 54, which are connected in series mutually.

The laser driving unit 11 includes a light-amount adjustment variable resistance 30, a gain control circuit (a current supply unit) 39, an EEPROM 44, a threshold-current calculation circuit 45, a bias-current calculation circuit 46, light-amount control modules APC-H 32, APC-M 34, and APC-L 36 (hereinafter referred to as "APC-H 32", "APC-M 34", and "APC-L 36"), switches 31, 40, 47, 50, and 51 (hereinafter referred to as "SW 31", "SW 40", "SW 50", and "SW 51"), a V-I conversion circuit (a) (a current supply unit) 41, a V-I conversion circuit (b) 48, an adder 49, and capacitors 33, 35, and 37.

The laser control unit 52 respectively outputs a switch control signal A, switch control signal B, and switch control signal C, which are different 3-bit signals, to the SW 31, SW47, and SW 50. Moreover, the laser control unit 52 outputs a sample/hold signal S/H1 to the APC-H 32 and SW40, outputs a sample/hold signal S/H2 to the APC-M 34, and outputs a sample/hold signal S/H3 to the APC-L 36. It should be noted that the signal S/H1, signal S/H2, and signal S/H3 are controlled so as not to become a High level simultaneously. The laser control unit 52 outputs each signal on the basis of contents of a table in which a generating timing of a BD signal and a count value of a counter (not shown) are associated with a signal output timing.

The SW 31 is provided with terminals 31*a*, 31*b*, 31*c*, and 31*d*. The PD 14 is connected to the terminal 31*a* of the SW 31 and one end of the light-amount adjustment variable resistance 30. The other end of the light-amount adjustment variable resistance 30 is grounded.

The PD 14, which is a photoelectric conversion element, outputs a current corresponding to a received light amount. The voltage determined by the current output from the PD 14 and the resistance of the light-amount adjustment variable resistance 30 is input to the input terminal 31*a* of the SW 31. Since there is individual specificity in the PD 14, the resistance of the light-amount adjustment variable resistance 30 is adjusted at a factory so that the voltage impressed to the input terminal 31*a* becomes a target voltage.

Figure 3B:
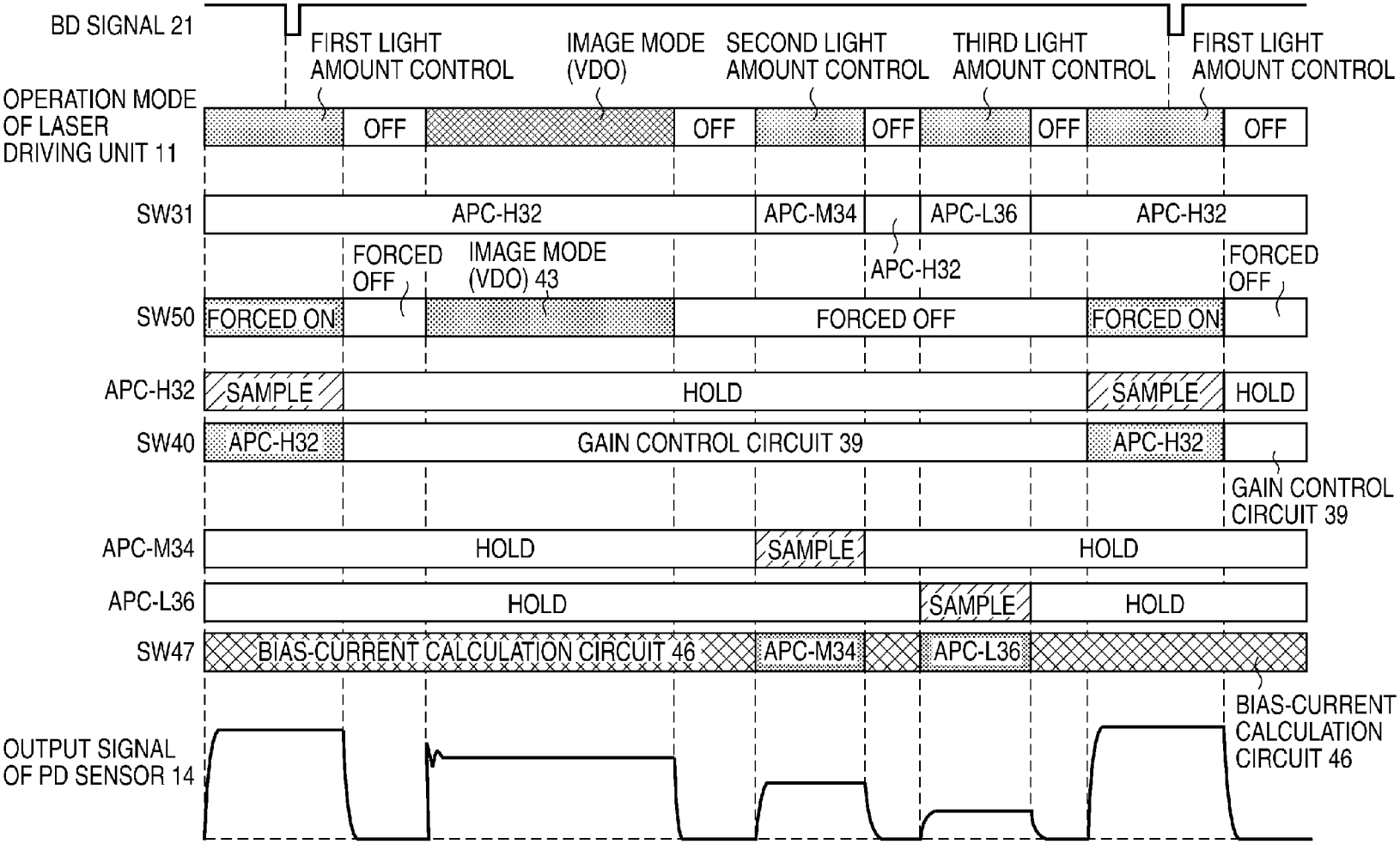
FIG. 3B is a timing chart showing states of members included in a laser driving unit shown in FIG. 3A in each control mode.

The terminal 31*b* of the SW 31 is connected to the APC-H 32. The terminal 31*c* of the SW 31 is connected to the APC-M 34. The terminal 31*d* of the SW 31 is connected to the APC-L 36. The SW 31 switches the connection destination of the terminal 31*a* among the terminals 31*b* through 31*d* according to a 3-bit switch control signal A from the laser control unit 52. That is, as shown in FIG. 3B, when operating the APC-H 32, the laser control unit 52 transmits a first light-amount-control-mode signal to the SW 31 as the switch control signal A to connect the terminal 31*a* with the terminal 31*b*. Similarly, when operating the APC-M 34, the laser control unit 52 transmits a second light-amount-control-mode signal to the SW 31 as the switch control signal A to connect the terminal 31*a* with the terminal 31*c*. Furthermore, when operating the APC-L 36, the laser control unit 52 transmits a third light-amount-control-mode signal to the switch 31 as the switch control signal A to connect the terminal 31*a* with the terminal 31*d*.

The SW 50 is provided with terminals 50*a*, 50*b*, 50*c*, and 50*d*. The terminal 50*a* is connected to a base terminal of a transistor 42. Moreover, a forced ON signal output from the laser control unit 52 is input into the terminal 50*b*. A PWM signal that is a pulse signal generated on the basis of image data is input into the terminal 50*c*. A forced OFF signal output from the laser control unit 52 is input into the terminal 50*d*. The SW 50 switches the connection destination of the terminal 50*a* among the terminals 50*b* through 50*d* according to a 3-bit switch control signal B from the laser control unit 52. The switch control signal B includes a forced ON mode signal, a forced OFF mode signal, and an image mode signal.

That is, as shown in FIG. 3B, when the forced ON mode signal is input from the laser control unit 52, the SW 50 connects the terminals 50*a* and 50*b*. When the terminals 50*a* and 50*b* are connected, the transistor 42 turns ON, and a current output from the V-I conversion circuit (a) 41 is output to the adder 49 through the transistor 42. Moreover, when the forced OFF signal output from the laser control unit 52 is input, the SW 50 connects the terminals 50*a* and 50*d*. When the terminals 50*a* and 50*d* are connected, the transistor 42 turns OFF, the current from the V-I conversion circuit (a) 41 does not flow through the transistor 42. Accordingly, the current concerned is not output to the adder 49. Furthermore, when the image mode signal is input from the laser control unit 52, the SW 50 connects the terminals 50*a* and 50*c*. The PWM signal input into the terminal 50*c* is input into the base terminal of the transistor 42 by connecting the terminals 50*a* and 50*c*. For example, when the PWM signal is at a High level, the transistor 42 turns ON, and the current output from the V-I conversion circuit (a) 41 is output to the adder 49 through the transistor 42. On the other hand, when the PWM signal is at a Low level, the transistor 42 turns OFF, the current from the V-I conversion circuit (a) 41 does not flow through the transistor 42. Accordingly, the current concerned is not output to the adder 49.

The laser control unit 52 outputs a signal S/H1 to the APC-H 32, as shown in FIG. 3A. When outputting the signal S/H1 at a High level to the APC-H 32, the laser control unit 52 outputs the first light-amount-control-mode signal to the SW 31, and outputs the forced ON mode signal to the SW 50. The APC-H 32 samples the output voltage from the PD 14 when receiving the signal S/H1 at a High level.

Similarly, the laser control unit 52 outputs a signal S/H2 to the APC-M 34, as shown in FIG. 3A. When outputting the signal S/H2 at a High level to the APC-M 34, the laser control unit 52 outputs the second light-amount-control-mode signal to the SW 31, and outputs the forced ON mode signal to the SW 50. The APC-M 34 samples the output voltage from the PD 14 when receiving the signal S/H2 at a High level.

Similarly, the laser control unit 52 outputs a signal S/H3 to the APC-L 36, as shown in FIG. 3A. When outputting the signal S/H3 at a High level to the APC-L 36, the laser control unit 52 outputs the third light-amount-control-mode signal to the SW 31, and outputs the forced ON mode signal to the SW 50. The APC-L 36 samples the output voltage from the PD 14 when receiving the signal S/H3 at a High level.

The SW 40 is provided with terminals 40*a*, 40*b*, and 40*c*. As shown in FIG. 3A, the terminal 40*a* is connected to the gain control circuit 39, the terminal 40*b* is connected to the APC-H 32 through a subtracting circuit 38, and the terminal 40*c* is connected to the V-I conversion circuit (a) 41 through an adder 38*a*. The signal S/H1 is input into the SW40 as shown in FIG. 3A. When the signal S/H1 is at a High level, the SW 40 connects the terminal 40*b* with the terminal 40*c*. On the other hand, when the signal S/H1 is at a Low level, the SW 40 connects the terminal 40*a* with the terminal 40*c*.

The SW 47 is provided with terminals 47*a*, 47*b*, 47*c*, and 47*d*. As shown in FIG. 3A, the terminal 47*a* is connected to the APC-M 34, the terminal 47*b* is connected to the bias current calculation circuit 46, the terminal 47*c* is connected to the APC-L 36, and the terminal 47*d* is connected to the V-I conversion circuit (b) 48. The SW 47 switches the connection destination of the terminal 47*d* among the terminals 47*a* through 47*c* according to a switch control signal C. The switch control signal C synchronizes with the signal S/H2 and signal S/H3. That is, when the signal S/H2 is at a High level, the laser control unit 52 outputs the switch control signal C that connects the terminal 47*a* and the terminal 47*d* to the SW 47. In response to the switch control signal C concerned, the SW 47 connects the terminal 47*a* and the terminal 47*d*. Moreover, when the signal S/H3 is at a High level, the laser control unit 52 outputs the switch control signal C that connects the terminal 47*c* and the terminal 47*d* to the SW 47. In response to the switch control signal C concerned, the SW 47 connects the terminal 47*c* and the terminal 47*d*. When both the signal S/H2 and the signal S/H3 are at a High level, the laser control unit 52 outputs the switch control signal C that connects the terminal 47*b* and the terminal 47*d* to the SW 47. In response to the switch control signal C concerned, the SW 47 connects the terminal 47*b* and the terminal 47*d*.

The following TABLE 1 shows the control states of the components that vary according to the switch control signal A through the switch control signal C and the signal S/H1 through the signal S/H3 that are described above. In the TABLE 1, a first control mode, a second control mode, and a third control mode respectively correspond to the first light-amount control mode, the second light-amount control mode, and the third light-amount control mode.

TABLE 1

| | APC-H32 | APC-M34 | APC-L36 | SW31 | SW40 | SW47 | SW50 |
|---|---|---|---|---|---|---|---|
| First control mode | Sample | Hold | Hold | AP-H32 | APC-H32 | Bias current | ON |
| Second control mode | Hold | Sample | Hold | APC-M34 | Gain control | APC-M34 | OFF |
| Third control mode | Hold | Hold | Sample | APC-L36 | Gain control | APC-L36 | OFF |
| Image mode | Hold | Hold | Hold | APC-H32 | Gain control | Bias current | VDO |
| OFF mode | Hold | Hold | Hold | APC-H32 | Gain control | Bias current | OFF |

Each of the APC-H 32, the APC-M 34, and the APC-L 36 controls the light amount of the semiconductor laser 12 according to the PD voltage. The PD voltage is obtained by converting the current that occurs with the PD sensor 14 by the light-amount adjustment variable resistance 30. The APC-H 32, the APC-M 34, and the APC-L 36 output the output signals to the SW 51, and one output signal selected by the SW 51 from among the output signals concerned is output to the ADC 54.

The APC-H 32 is a module that operates in first light amount control. The APC-M 34 is a module that operates in second light amount control. The APC-L 36 is a module that operates in third light amount control. Since the APC-H 32, the APC-M 34, and the APC-L 36 have the same configurations, an internal configuration of the APC-H 32 will be described as a representative.

Figure 5:
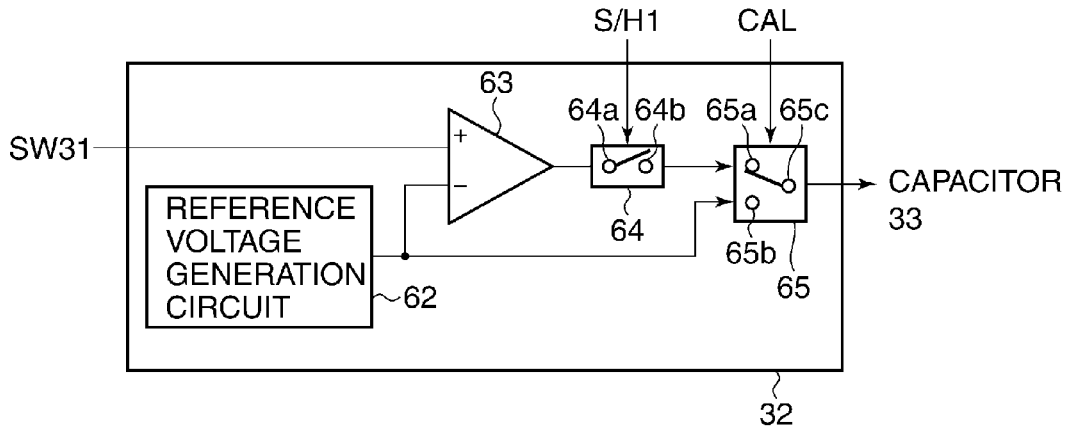
FIG. 5 is a block diagram schematically showing an internal configuration of an APC-H shown in FIG. 3A.

FIG. 5 is a block diagram schematically showing the internal configuration of the APC-H 32 shown in FIG. 3A.

The APC-H (a voltage control unit) 32 in FIG. 5 includes a reference voltage generation circuit (a reference voltage generation unit) 62, a comparator 63, a switch 64 (hereinafter referred to as a "SW 64") equipped with terminals 64*a* and 64*b*, a switch 65 (hereinafter referred to as a "SW 65") equipped with terminals 65*a*, 65*b*, and 65*c*. The reference voltage generation circuit 62 is formed from a bandgap circuit etc. The voltage that the reference voltage generation circuit 62 outputs is hardly affected by temperature changes. A reference voltage Vref1 output from the reference voltage generation circuit 62 is input to a minus terminal of the comparator 63 and to the terminal 65*b* of the SW 65. A plus terminal of the comparator 63 is connected to the terminal 31*b* of the SW 31. An output terminal of the comparator 63 is connected to the terminal 64*a* of the SW 64 that is ON-OFF controlled by the signal S/H1. In the SW64, the terminal 64*a* and the terminal 64*b* are connected when the signal S/H1 is at a High level, and the connection between the terminal 64*a* and the terminal 64*b* is released when the signal S/H1 is at a Low level. The terminal 64*b* is connected to the terminal 65*a* of the SW 65.

The SW 65 switches the connection destination of the terminal 65*c* between the terminals 65*a* and 65*b* according to a CAL signal from the laser control unit 52. In the first embodiment, the terminal 65*a* and the terminal 65*c* shall be connected.

The comparator 63 compares the PD voltage Vpd with the reference voltage Vref1 generated with the reference voltage generation circuit 62. In the first light-amount control mode, the SW 64 turns ON according to the signal S/H1 output from the laser control unit 52. When the SW64 turns ON, the capacitor (a voltage setting unit) 33 is charged and discharged on the basis of the comparison result of the comparator 63. That is, when the inequality "Vref1>Vpd" holds, since the light amount of the incident light to the PD 14 is lower than the target light amount corresponding to the reference voltage Vref1, the comparator 63 charges the capacitor 33. On the other hand, when the inequality "Vref1<Vpd" holds, since the light amount of the incident light to the PD 14 is higher than the target light amount corresponding to the reference voltage Vref1, the comparator 63 discharges the capacitor 33. When the equation "Vref1=Vpd" holds, since the light amount of the incident light to the PD 14 is equal to the target light amount corresponding to the reference voltage Vref1, the comparator 63 maintains the voltage of the capacitor 33. When the first light-amount control mode has completed, the signal S/H1 becomes a Low level, and thereby, the SW 64 turns OFF. When the SW 64 turns OFF, a voltage Vch1 of the capacitor 33 is held.

It should be noted that voltages output from reference voltage generation circuits in the APC-M 34 and the APC-L 36 are different from that in the APC-H 32, respectively. That is, the reference voltage generation circuit in the APC-M 34 outputs a reference voltage Vref2, and the reference voltage generation circuit in the APC-M 36 outputs a reference voltage Vref3. In the first embodiment, the inequality "Vref1>Vref2>Vref3" shall hold. Specifically, the reference voltage Vref2 is 50% of the reference voltage Vref1, and the reference voltage Vref3 is 25% of the reference voltage Vref1.

The subtractor 38 subtracts a voltage corresponding to a threshold current that is calculated by the threshold current calculation circuit 45 mentioned later from the held voltage Vch1 of the capacitor 33, and outputs the subtracted voltage to the gain control unit 39 mentioned later. Then, the gain control unit 39 adjusts the gain of the input voltage, and the adjusted voltage Vchg1 is input to the V-I conversion circuit (a) 41. The V-I conversion circuit (a) 41 outputs a driving current $I_{sw}$ (a switching current) according to the adjusted voltage Vchg1. In the state where the terminals 50*a* and 50*c* of the SW 50 are connected because the image mode is set, the PWM signal at a High level is input to the transistor 42, which allows the transistor 42 to conduct a current, and the driving current $I_{sw}$ is supplied to the adder 49. On the other hand, in the state where the PWM signal at a Low level is input to the transistor 42, the transistor 42 does not conduct a current, and the driving current $I_{sw}$ is not supplied to the adder 49.

As the voltage Vch1 of the capacitor 33 was prescribed by the operation of the APC-H 32 in the first light-amount control mode, a voltage Vch2 of the capacitor 35 is prescribed by the operation of the APC-M 34 in the second light-amount control mode. Similarly, a voltage Vch3 of the capacitor 37 is prescribed by the operation of the APC-L 36 in the third light-amount control mode. The threshold current calculation circuit 45 calculates a threshold current $I_{th}$ according to the following formula (1) on the basis of a current value $I_M$ corresponding to the held voltage Vch2 of the capacitor 37 and a current value $I_L$ corresponding to the held voltage Vch3 of the capacitor 37.

$$I_{th}=I_L-[(\text{Light amount controlled by APC-L})/\{(\text{Light amount controlled by APC-M})-(\text{Light amount controlled by APC-L})\}]\cdot(I_M-I_L) \quad (1)$$

The bias current calculation circuit 46 calculates a bias current $I_b$ by multiplying the threshold current $I_{th}$ calculated by the threshold current calculation circuit 45 by an arbitrary coefficient α as indicated by the following formula (2).

$$I_b=\alpha\cdot I_{th}\ (\alpha\leq 1) \quad (2)$$

The V-I conversion circuit 48 outputs the bias current $I_b$ calculated by the bias current calculation circuit 46 to the adder 49.

When the driving current $I_{sw}$ is input, the adder 49 supplies a current, which is obtained by superimposing the driving current $I_{sw}$ on the bias current $I_b$, to the semiconductor laser 12. When the driving current $I_{sw}$ is not input, the adder 49 supplies the bias current $I_b$ to the semiconductor laser 12. That is, the bias current $I_b$ is supplied to the semiconductor laser 12 irrespective of the PWM signal, and the driving current $I_{sw}$ is supplied to the semiconductor laser 12 only when the PWM signal is at a High level.

Figure 4:
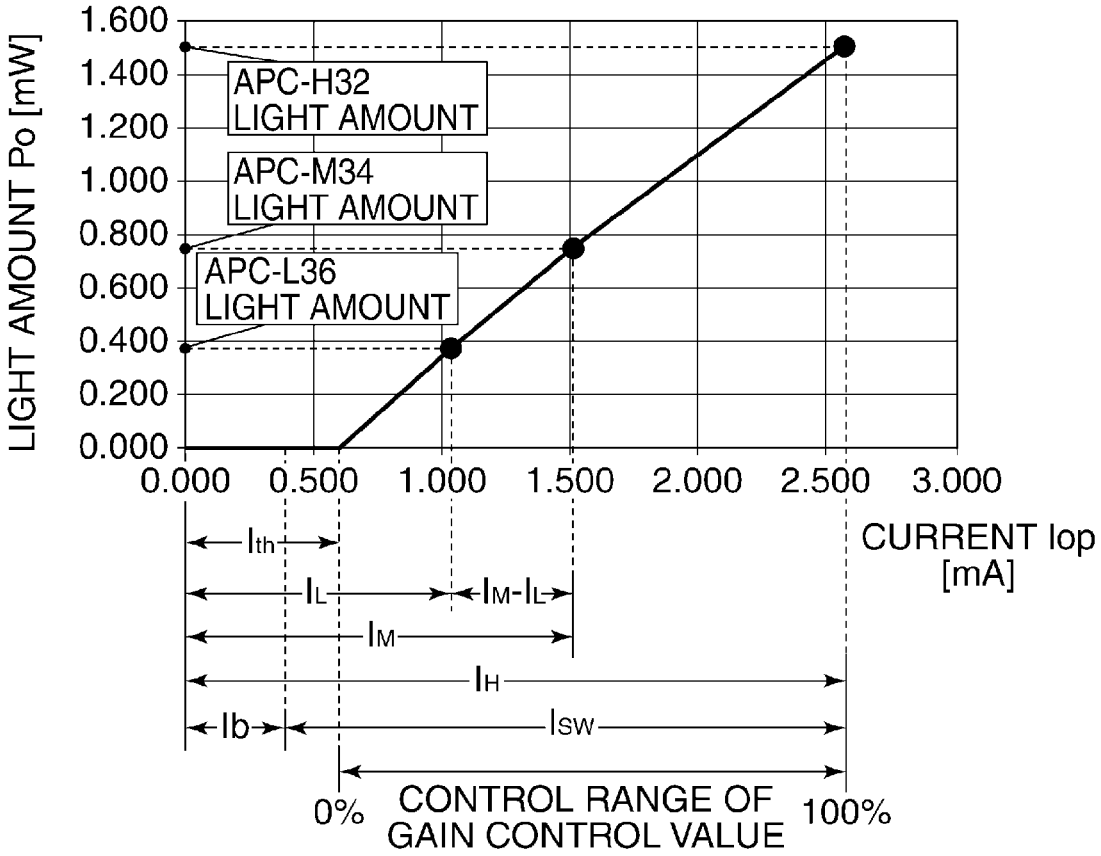
FIG. 4 is a graph showing gain control by means of a gain control circuit shown in FIG. 3A.

When the laser driving unit 11 is set in the image mode (VDO) by the laser control unit 52, the gain control circuit 39 controls the light amount of the semiconductor laser 12 according to the gain control value output from the laser control unit 52. The gain control value is set within a range from 0% to 100%. As shown in FIG. 4, the gain control circuit 39 controls the light amount of the semiconductor laser 12 within a light amount range corresponding to the range of the driving current excluding the threshold current $I_{th}$ from a current value $I_H$ corresponding to the held voltage Vch1 of the capacitor 33, i.e., the light amount range from 0 to the light amount controlled by the APC-H 32.

Figure 9A:
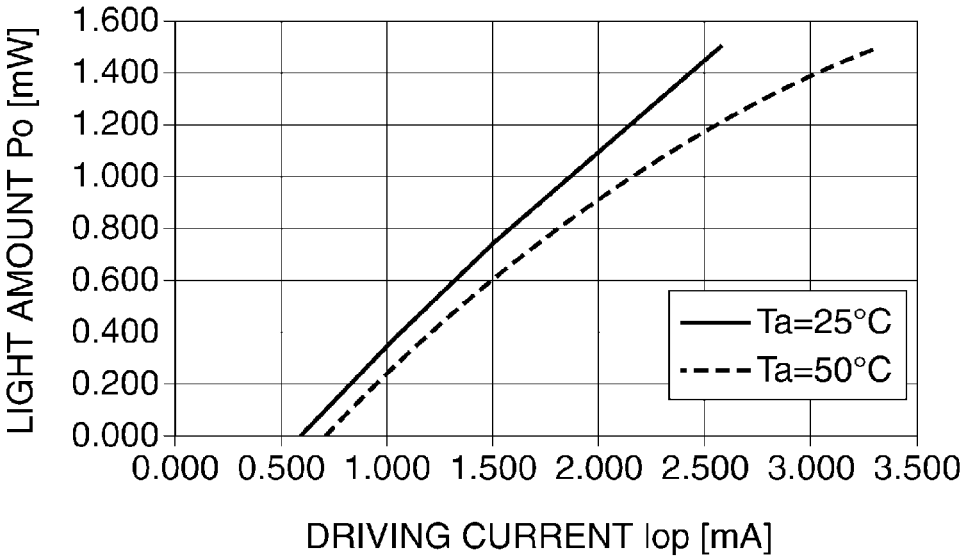
FIG. 9A is a graph showing the driving-current/light-amount characteristics of a semiconductor laser at different temperatures.

As shown in FIG. 9A, an emission characteristic of the semiconductor laser 12 varies with ambient temperature. Accordingly, if the gain control value is fixed irrespective of the variation of the emission characteristic, the light amount of the light beam emitted from the semiconductor laser 12 in the image mode will not agree with the target light amount.

For example, if the gain control value shall be set to 70%, the gain control circuit 39 will reduce the voltage, which is obtained by subtracting the voltage corresponding to the threshold current calculated by the threshold current calculation circuit 45 from the voltage Vch1 of the capacitor 33, so as to be 70%.

It is assumed that the input voltage to the gain control circuit 39 in the case where the gain control value is 100% is equivalent to the light amount of 1.000 mW of the light beam that scans the photosensitive drum in FIG. 9A. The light amount of 1.000 mW in the case where the temperature is 25° C. requires the driving current of about 1.80 mA. And the driving current where the gain control value is 70% becomes about 1.26 mA. On the other hand, in the case where the temperature is 50° C., the driving current of about 2.20 mA is required and the driving current where the gain control value is 70% becomes about 1.54 mA. If the threshold currents $I_{th}$ in the temperatures of 25° C. and 50° C. are about 0.96 mA and 1.12 mA, respectively, the current supplied to the semiconductor laser 12 in the temperature of 25° C. is about 2.22 mA, and the current supplied to the semiconductor laser 12 in the temperature of 50° C. is about 2.66 mA. When the current of about 2.22 mA is supplied to the semiconductor laser 12 at the temperature of 25° C., the amount of light emission becomes about 1.20 mW. When the current of about 2.66 mA is supplied to the semiconductor laser 12 at the temperature of 50° C., the amount of light emission becomes about 1.25 mW. Thus, if the gain control value is fixed to a constant value irrespective of the temperature, the light amount of the laser beam that scans the photosensitive drum varies as mentioned above.

Accordingly, the image forming apparatus according to the first embodiment reduces the variation of the light amount of the laser beam that scans the photosensitive drum by controlling the gain using the gain control value corresponding to the temperature.

Figure 6:
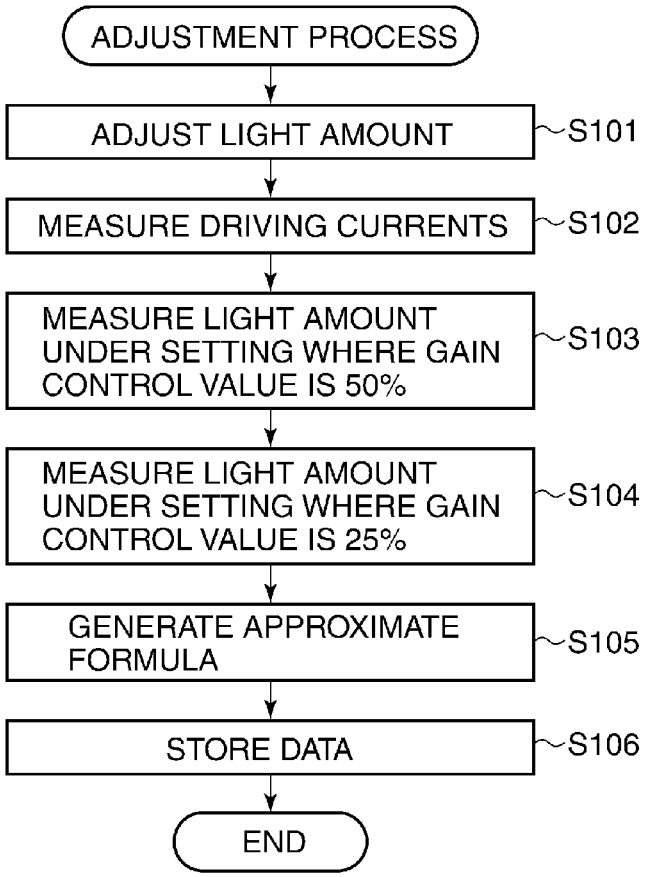
FIG. 6 is a flowchart showing procedures of an adjustment process for a gain control value executed by the laser control system in FIG. 3A.

FIG. 6 is a flowchart showing procedures of an adjustment process for the gain control value executed by the laser control system 300 in FIG. 3A.

The adjustment process in FIG. 6 is performed when the laser control unit 52 drives the laser driving unit 11 with a control signal.

The adjustment process in FIG. 6 is performed when the optical scanning devices 5*a*, 5*b*, 5*c*, and 5*d* are assembled and adjusted under the condition of the environmental temperature Ta=25° C. During the adjustment process, an approximate formula (3) for the gain control value mentioned later is generated on the basis of the relationship between the light amount that was measured and the gain control value that was set.

As shown in FIG. 6, the first light-amount control mode in Table 1 is set first under the condition of Ta=25° C., the light-amount adjustment variable resistance 30 is adjusted so that the light amount of the semiconductor laser 12 is adjusted to become the preset light amount (step S101), and the driving current $I_H$ that occurs under the control by the APC-H 32 in the first light-amount control mode is measured. Next, the second light-amount control mode and the third light-amount control mode are set in turn under the condition of Ta=25° C., and the driving current $I_M$ that occurs under the control by the APC-M 34 in the second light-amount control mode and the driving current $I_L$ that occurs under the control by the APC-L 36 in the third light-amount control mode are measured (step S102).

Next, the image mode in Table 1 is set, the gain control value of 50% is set to the gain control circuit 39, and the light amount of the light emitting section is measured (step S103). Then, the gain control value of 25% is set to the gain control circuit 39, and the light amount of the light emitting section is measured (step S104).

The light amount in the gain control value of 50% measured in the step S103 is equivalent to the light amount in the second light-amount control mode. The light amount in the gain control value of 25% measured in the step S104 is equivalent to the light amount in the third light-amount control mode. That is, the driving current $I_M$ corresponding to the gain control value of 50% set in the step S103 and the driving current $I_L$ corresponding to the gain control value of 25% set in the step S104 are measured in the step S102.

Figure 7A:
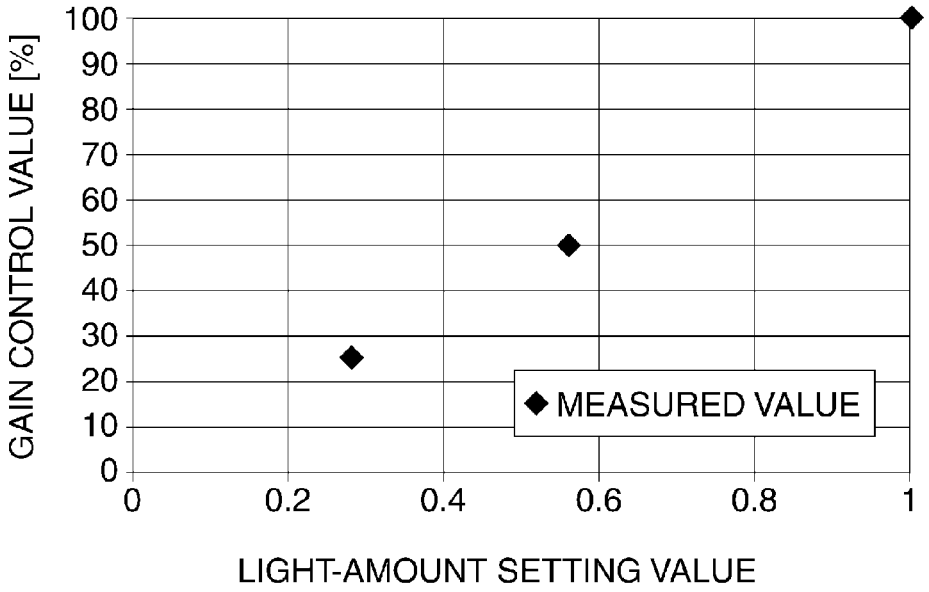
FIG. 7A and FIG. 7B are graphs showing actually detected gain control values and their approximate characteristic in the adjustment process in FIG. 6.

Next, the light-amount setting values in the gain control values of 50% and 25% are calculated on the basis of the light amounts measured in the steps S103 and S104 on the presumption that the light amount under the control by the APC-H 32 of which the gain control value is 100% is the light-amount setting value of "1.00". The light-amount setting values in the gain control values of 50% and 25% are equivalent to values obtained by normalizing the light amounts in the gain control values of 50% and 25% by the light amount in the gain control value of 100%. Then, the calculated values are plotted on the graph shown in FIG. 7A. It should be noted that the light-amount setting value (the voltage of the capacitor 33 in the holding state) is equivalent to the image density of the image forming apparatus 1 at the time when the laser driving unit 11 is set in the image mode.

Figure 7B:
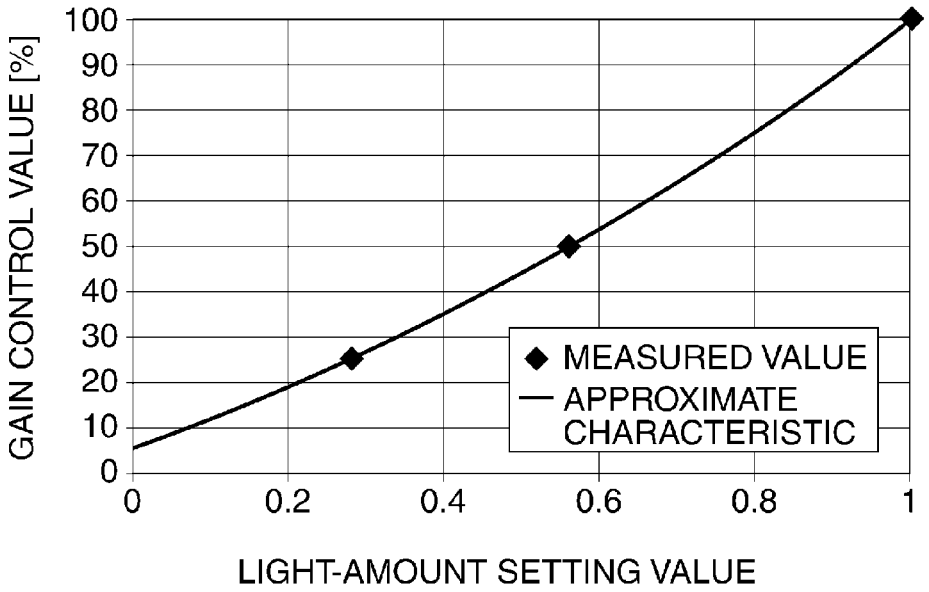

A gain control value can be calculated with an n-th degree formula (n≥1) from each light-amount setting value. In the first embodiment, since the relation between the light-amount setting value and the gain control value is expressed by a quadratic function as shown in FIG. 7B, the gain control value is computable with the following approximate formula (3) using coefficients a, b, and c.

$$\text{Gain control value}=a\cdot(\text{Light-amount setting value})^2+b\cdot(\text{Light-amount setting value})+c \quad (3)$$

Referring back to FIG. 6, the above-mentioned approximate formula (3) with which the gain control value is calculated from the light-amount setting value is generated on the basis of the light amounts measured in the steps S103 and S104 (step S105). Then, the driving currents ($I_H$, $I_M$, and $I_L$) that are measured in the step S102 and the data about the approximate formula (3) generated are stored in the EEPROM (step S106), and this process is finished.

According to the adjustment process in FIG. 6, the approximate formula (3) is generated on the basis of the light amounts measured under the conditions where the gain control values are 25% and 50%. Accordingly, since the gain control value is calculated from the light-amount setting value corresponding to the desired light amount using the approximate formula (3), and the light amount of the semiconductor laser 12 is controlled using the calculated gain control value, the desired light amount is obtained.

Figure 8:
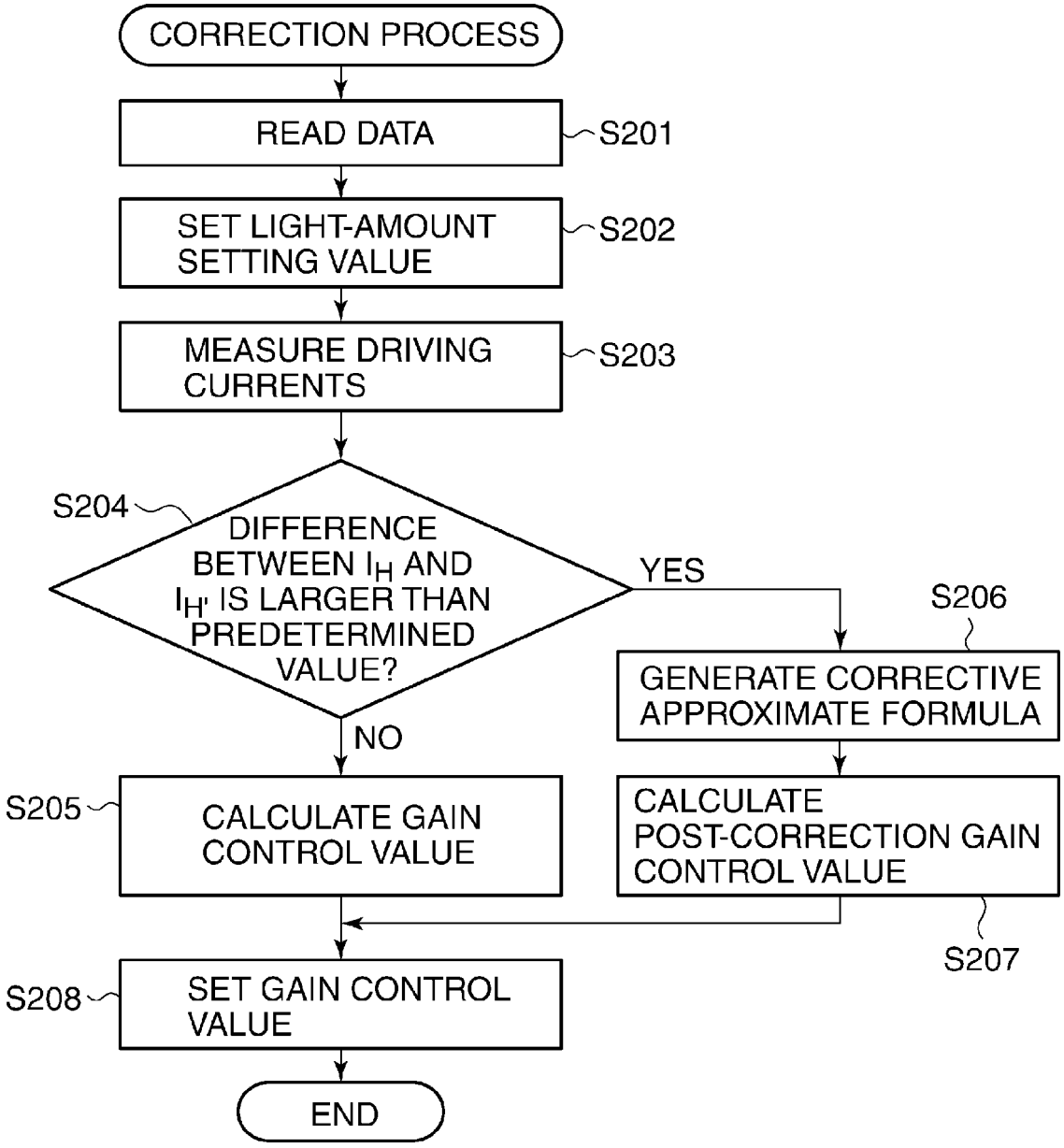
FIG. 8 is a flowchart showing procedures of a correction process that corrects the gain control value calculated through the adjustment process in FIG. 6.

FIG. 8 is a flowchart showing procedures of a correction process that corrects the gain control value calculated through the adjustment process in FIG. 6.

The correction process in FIG. 8 is performed when the laser control unit 52 outputs a control signal to the laser driving unit 11.

Figure 9B:
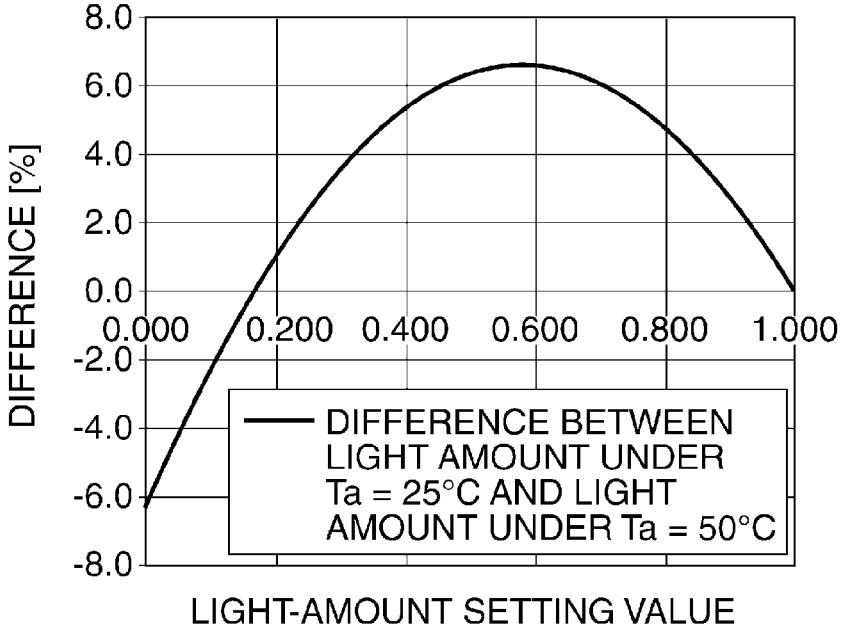
FIG. 9B is a graph showing a light amount difference due to temperature difference at the same light-amount setting value of the semiconductor laser.

The driving-current/light-amount characteristic of the semiconductor laser 12 controlled by the above-mentioned laser driving unit 11 varies due to a temperature change as shown in FIG. 9A. Accordingly, when the light amount of the semiconductor laser 12 is controlled using the gain control value calculated using the above-mentioned approximate formula (3) that is obtained under the condition of Ta=25° C., difference of about +7% occurs at the maximum within the range of the light-amount setting value from 0.200 to 1.000 as shown in FIG. 9B between the light amount of the semiconductor laser 12 controlled under the condition of Ta=25° C. and the light amount of the semiconductor laser 12 controlled under the condition of Ta=50° C.

In view of this defect, the correction process shown in FIG. 8 corrects the gain control value GCV calculated in the step S105 using the approximate formula (3) so as not to generate the difference of the light amounts of the semiconductor laser 12 owing to a temperature change even if the driving-current/light-amount characteristic varies due to a temperature change.

As shown in FIG. 8, the driving currents ($I_H$, $I_M$, and $I_L$) that are measured under the condition of Ta=25° C. and the data about the approximate formula (3), which were stored into the EEPROM in the step S106, are read (step S201), and a desired light-amount setting value is set (step S202).

Next, the first light-amount control mode is set under the condition of Ta=50° C., and the driving current $I_H'$ that occurs under the control by the APC-H 32 in the first light-amount control mode is measured. Then, the second light-amount control mode and the third light-amount control mode are set in turn under the condition of Ta=50° C., and the driving current $I_M'$ that occurs under the control by the APC-M 34 in the second light-amount control mode and the driving current $I_L'$ that occurs under the control by the APC-L 36 in the third light-amount control mode are measured (step S203).

Next, it is determined whether the difference between the driving current ($I_H'$) measured in the step S203 in the first light-amount control mode and the driving current ($I_H$) read in the step S201 is larger than a predetermined value (step S204). The above-mentioned predetermined value is calculated based on information about the difference in the light-amount setting values shown in FIG. 9B, for example.

Figure 10A:
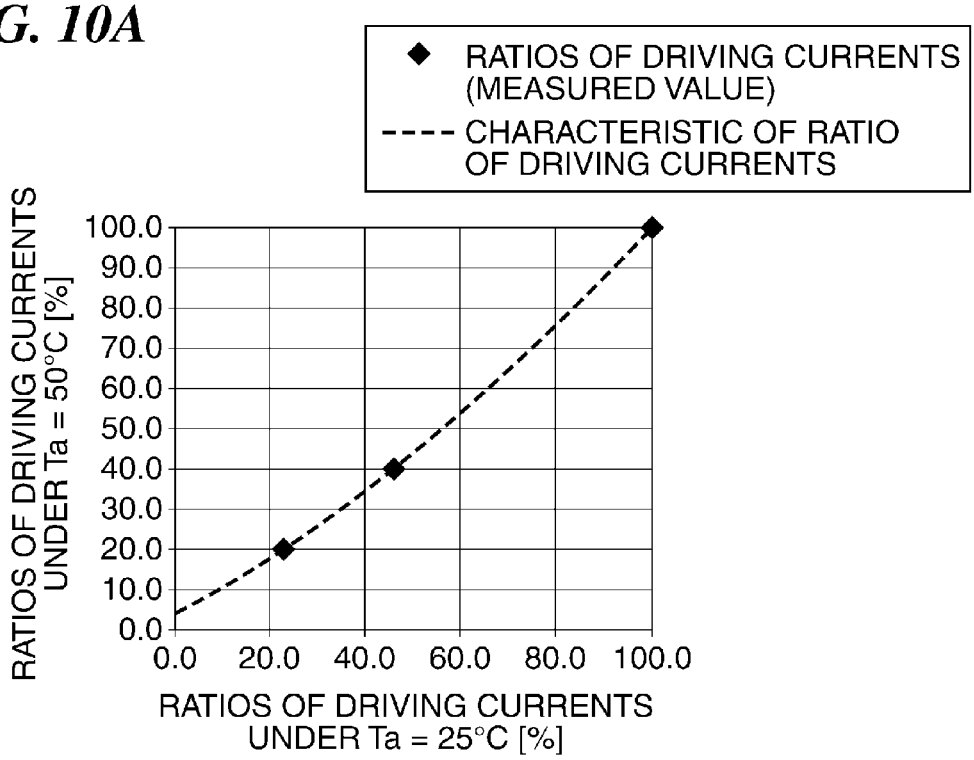
FIG. 10A is a graph showing a driving current ratio used in step S205 in FIG. 8 to generate a corrective approximate formula.

As a result of the determination in the step S204, when the above-mentioned difference is larger than the predetermined value, the following corrective approximate formula (4) is generated (step S206) by associating (for example, plotting on a graph as shown in FIG. 10A) the ratios of the driving currents ($I_H$, $I_M$, and $I_L$) that were read in the step S201 (that were measured under the condition of Ta=25° C.) with the ratios of the driving currents ($I_H'$, $I_M'$, and $I_L'$) that were measured in the step S203 (that were measured under the condition of Ta=50° C.).

The ratios of the driving currents measured under the condition of Ta=25° C. in the graph in FIG. 10A are calculated by normalizing the driving current in the second light-amount control mode and the driving current in the third light-amount control modes on the assumption that the driving current in the first light-amount control mode is equal to "1.000" under the condition of Ta=25° C. The ratios of the driving currents measured under the condition of Ta=50° C. are calculated by normalizing the driving current in the second light-amount control mode and the driving current in the third light-amount control modes on the assumption that the driving current in the first light-amount control mode is equal to "1.000" under the condition of Ta=50° C.

As shown in FIG. 10A, since the relationship between the ratios of the driving currents under the condition of Ta=25° C. and the ratios of the driving currents under the condition of Ta=50° C. is expressed by a quadric function in the first embodiment and the gain control value corresponds to the driving current, the post-correction gain control value is calculated by the following approximate formula (4) using correction coefficients d, e, and f.

$$(\text{Post-correction gain control value})=d\cdot(\text{Gain control value})^2+e\cdot(\text{Gain control value})+f \quad (4)$$

Figure 10B:
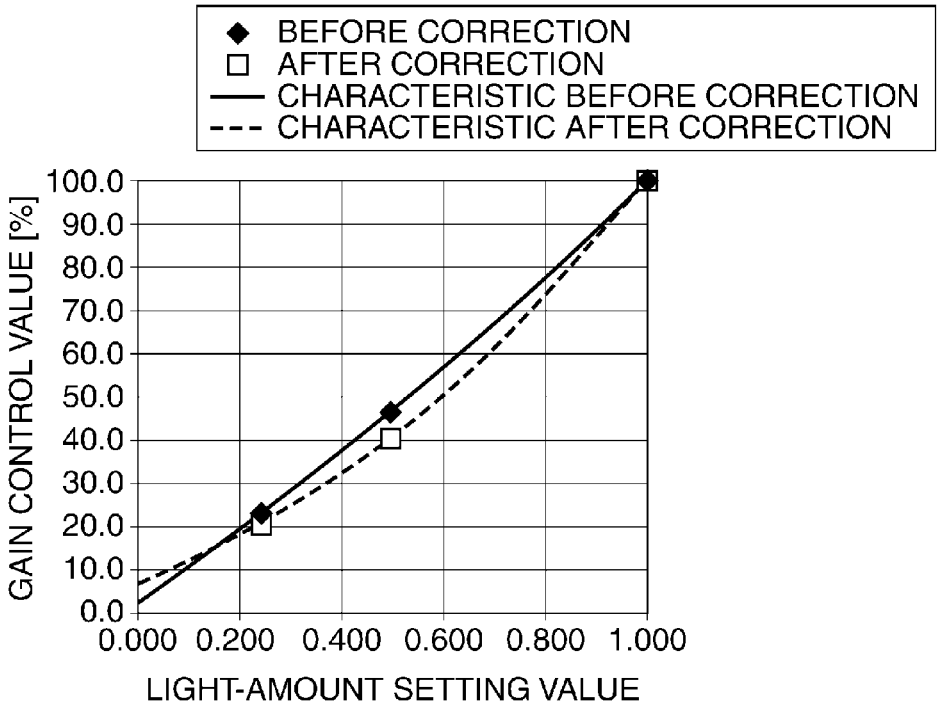
FIG. 10B is a graph showing a relationship between the post-correction gain control value calculated in step S207 in FIG. 8 and the light-amount setting value in comparison to the relationship before correction.

If the post-correction gain control value is calculated from the gain control value using the above-mentioned corrective approximate formula (4), the relation between the post-correction gain control value and the light-amount setting value will be indicated by a graph in FIG. 10B in the first embodiment.

Referring back to FIG. 8, when a desired light amount is required under the condition of Ta=50° C., the gain control value is calculated from the desired light-amount setting value using the approximate formula (3). Then, the post-correction gain control value is calculated from the calculated gain control value using the approximate formula (4) (step S207, a calculation unit). Furthermore, the post-correction gain control value calculated is set in the gain control circuit 39 (step S208), and this process is finished.

As a result of the determination in the step S204, when the above-mentioned difference is not larger than the predetermined value, the gain control value is calculated from the desired light-amount setting value using the approximate formula (3) for the gain control value read in the step S201 (step S205). Then, the calculated gain control value concerned is set in the gain control circuit 39 (step S208), and this process is finished.

Figure 11:
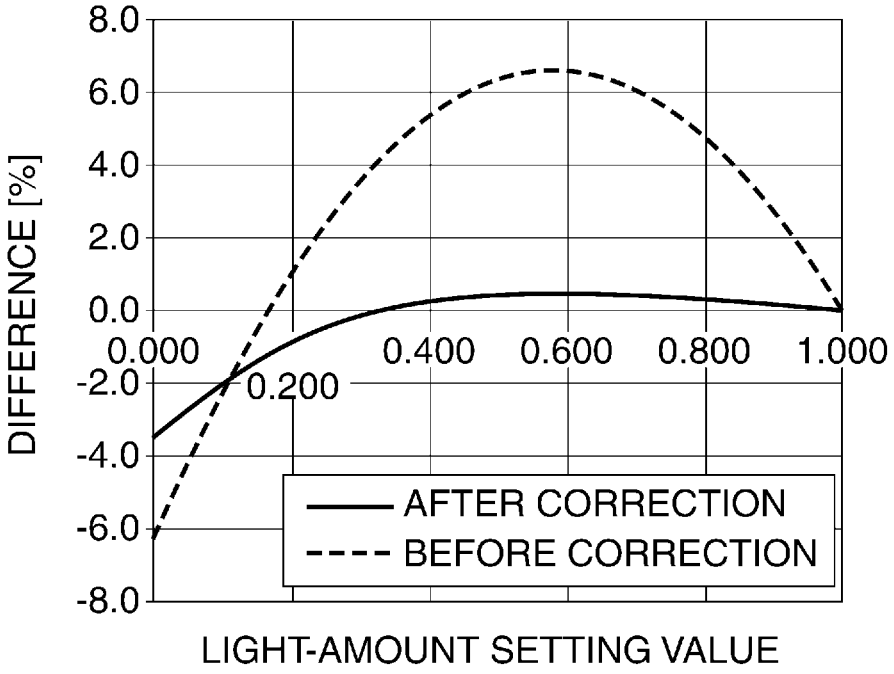
FIG. 11 is a graph showing the light amount differences due to temperature difference at the same light-amount setting value before and after the correction process in FIG. 8.

According to the correction process in FIG. 8, when the difference between the driving current ($I_H'$) in the first light-amount control mode that was measured in the step S203 (under the condition of Ta=50° C.) and the driving current ($I_H$) read in the step S201 (measured under the condition of Ta=25° C.) is larger than the predetermined value, the corrective approximate formula (4) is generated (the step S206) by associating the ratios of the driving currents ($I_H$, $I_M$, and $I_L$) measured under the condition of Ta=25° C. with the ratios of the driving currents ($I_H'$, $I_M'$, and $I_L'$) measured under the condition of Ta=50° C. Then, the post-correction gain control value is calculated using the corrective approximate formula (4) and is set (the steps S207 and S208). Accordingly, the desired light amount is obtained by reducing an influence of the difference between the driving-current/light-amount characteristic under the condition of Ta=25° C. and that under the condition of Ta=50° C. Specifically, as shown in the graph in FIG. 11, when the post-correction gain control value is used, the difference between the light amount of the semiconductor laser 12 under the condition of Ta=25° C. and the light amount of the semiconductor laser 12 under the condition of Ta=50° C. is minimized.

Moreover, since the durability of the semiconductor laser 12 deteriorates according to a lapse of time, the driving-current/light-amount characteristic varies according to a lapse of time. Accordingly, even if the desired light-amount setting value is constant, the light amounts of the semiconductor laser 12 measured in different time points may differ.

In view of this defect, a process similar to the correction process shown in FIG. 8 is performed to correct the gain control value calculated in the step S105 using the approximate formula (3) so that the light amount of the semiconductor laser 12 does not vary according to a lapse of time even if the durability of the semiconductor laser deteriorates.

Specifically, the driving currents in the first light-amount control mode, the second light-amount control mode, and the third light-amount control mode are measured at different times (first time and second time). Then, the driving currents in the first light-amount control mode at the first time and the second time are compared. When the comparison result is larger than a predetermined value, a corrective approximate formula similar to the corrective approximate formula (4) is generated by associating the ratios among the driving currents at the first time with the ratios among the driving currents at the second time. Then, a post-correction gain control value is calculated using the similar corrective approximate formula concerned, and the post-correction gain control value is set in the gain control circuit 39. Accordingly, the desired light amount is obtained by reducing an influence of the variation of the driving-current/light-amount characteristic that varies according to a lapse of time.

Next, an image processing apparatus according to a second embodiment of the present invention will be described.

Since the second embodiment is basically identical to the first embodiment in its configurations and actions, descriptions about the identical configurations and actions are omitted, and configurations and actions that are different from that in the first embodiment will be described in detail.

Figure 12A:
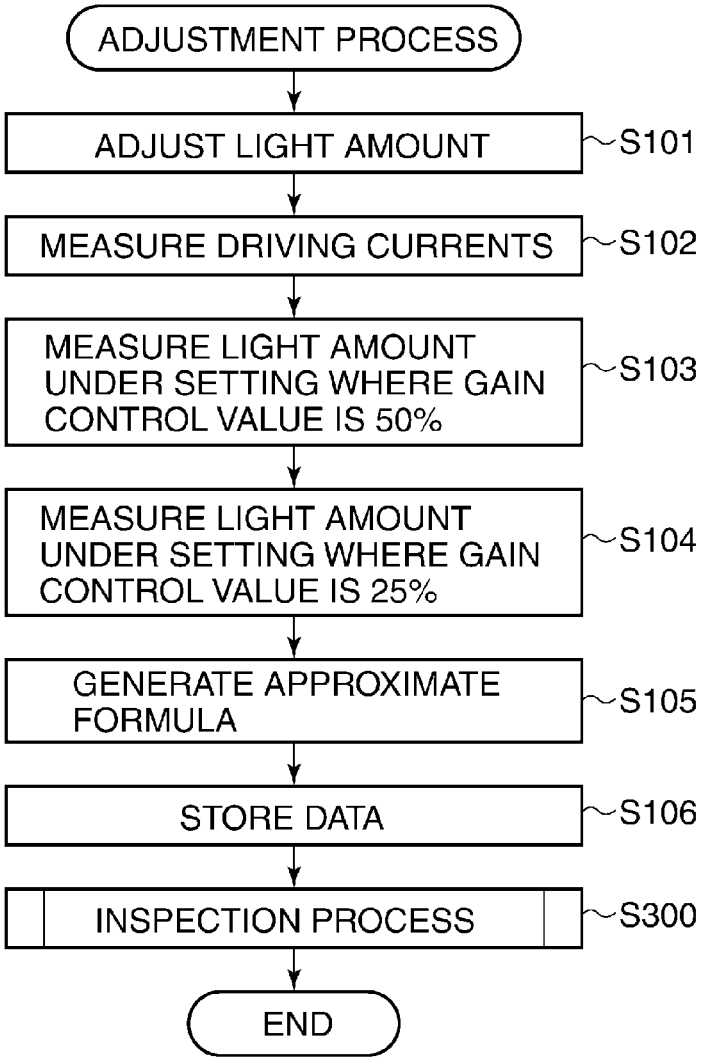
FIG. 12A is a flowchart showing procedures of an adjustment process according to a second embodiment of the present invention.

FIG. 12A is a flowchart showing procedures of an adjustment process according to the second embodiment.

The adjustment process in FIG. 12A is performed when the laser control unit 52 drives the laser driving unit 11 with a control signal.

In the adjustment process in FIG. 12A, an inspection process in the ADC 54 is performed in addition to the adjustment process in FIG. 6. The ADC 54 controls a digital signal (a driving current is also included) outputted on the basis of an analog signal (a driving current is also included). The ADC 54 tends to be affected by an ambient temperature change, and the output digital signal (driving current) varies due to an ambient temperature change.

In view of this defect, an inspection approximate formula (5) mentioned later is generated in the adjustment process in FIG. 12A by associating reference voltages that are input into the ADC 54 and are stored into the EEPROM 44 in the inspection process in FIG. 12B mentioned later with reference voltages output from the ADC 54 in an inspection process in FIG. 13B mentioned later. Then, the driving current output from the ADC 54 is corrected using the inspection approximate formula (5).

In FIG. 12A, the procedures in the steps S101 through S106 are executed first as with the adjustment process in FIG. 6. Next, the inspection process in FIG. 12B mentioned later is executed (step S300), and this process is finished. Although the inspection process in the step S300 is executed after the step S106 in the adjustment process in FIG. 12A, the step S300 may be executed at any timing in the adjustment process in FIG. 12A.

Figure 12B:
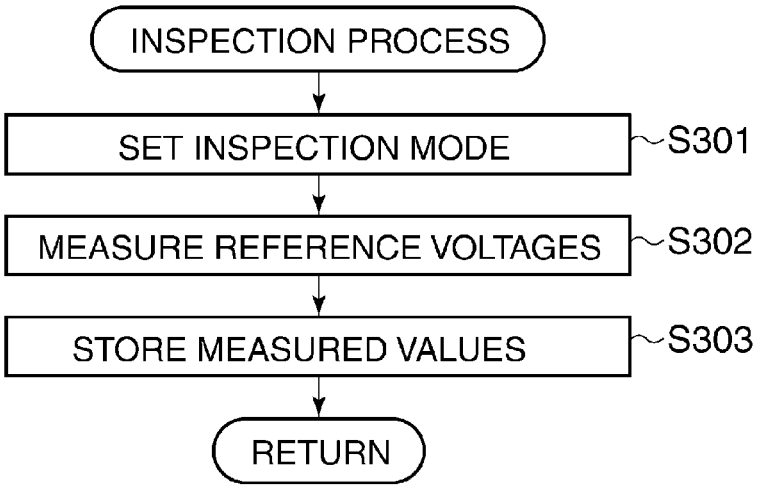
FIG. 12B is a flowchart showing procedures of an inspection process executed in step S300 in FIG. 12A.

FIG. 12B is a flowchart showing procedures of the inspection process executed in the step S300 in FIG. 12A.

The inspection process in FIG. 12B is performed when the laser control unit 52 drives the laser driving unit 11 with a control signal.

As shown in FIG. 12B, the APC-H 32, the APC-M 34, and the APC-L 36 are set to an inspection mode with an inspection signal CAL (step S301). Then, the reference voltages are measured at the output terminal of the SW 51 while switching the connection of the SW 51 (step S302). Since the output terminal of the SW 51 is connected to the input terminal of the ADC 54, the reference voltages measured in the step S302 are identical to the reference voltages input into the ADC 54. Then, the measured reference voltages are stored in the EEPROM 44, the inspection mode is released (step S303), and this process is finished.

Figure 13A:
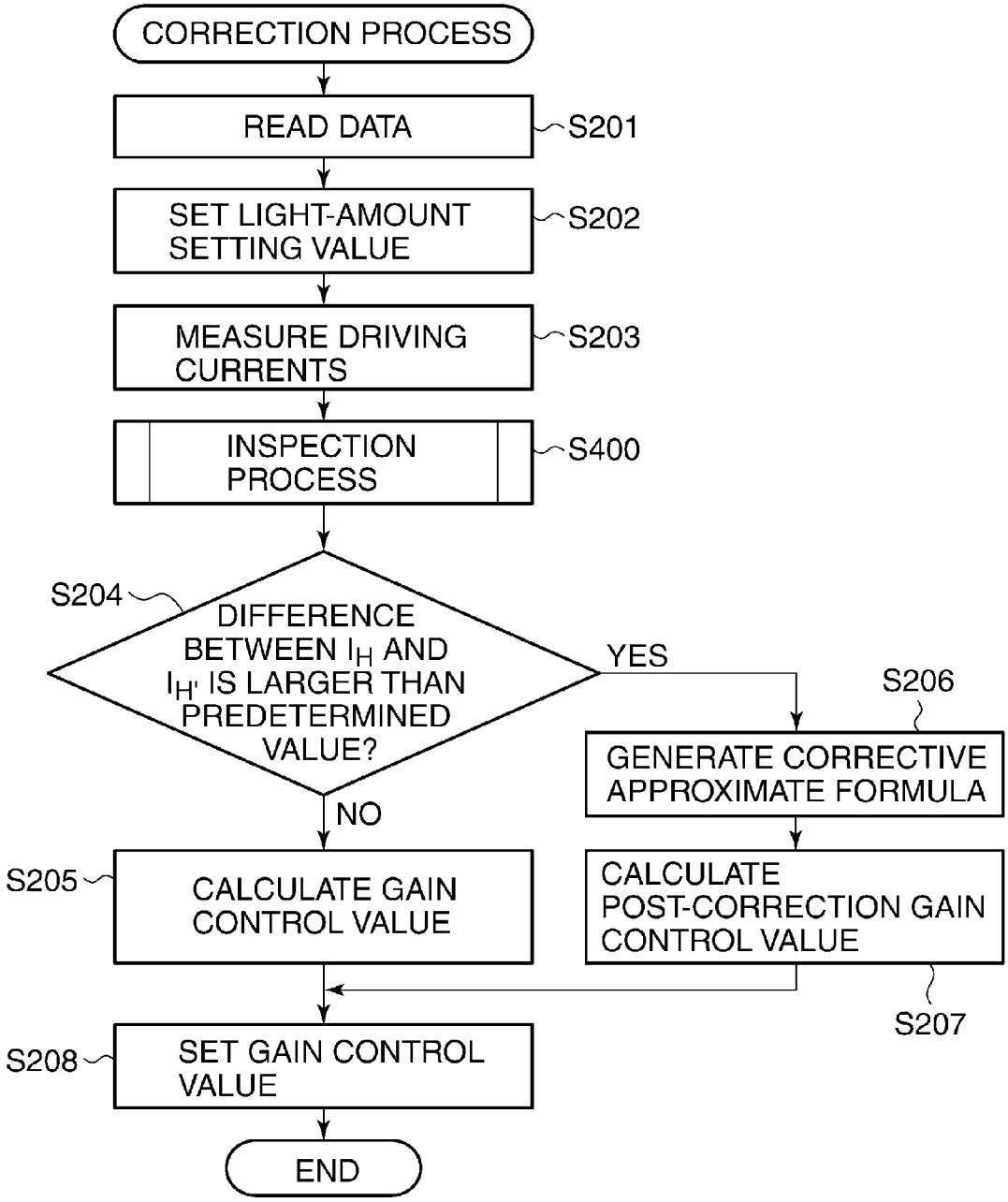
FIG. 13A is a flowchart showing procedures of a correction process according to the second embodiment.

FIG. 13A is a flowchart showing procedures of a correction process according to the second embodiment.

The correction process in FIG. 13A is performed when the laser control unit 52 drives the laser driving unit 11 with a control signal.

In FIG. 13A, the procedures in the steps S201 through S203 are executed first as with the correction process in FIG. 8. Next, the inspection process in FIG. 13B mentioned later is executed (step S400). Then, the procedures in and after the step S204 are performed as with the correction process in FIG. 8, and this process is finished.

Figure 13B:
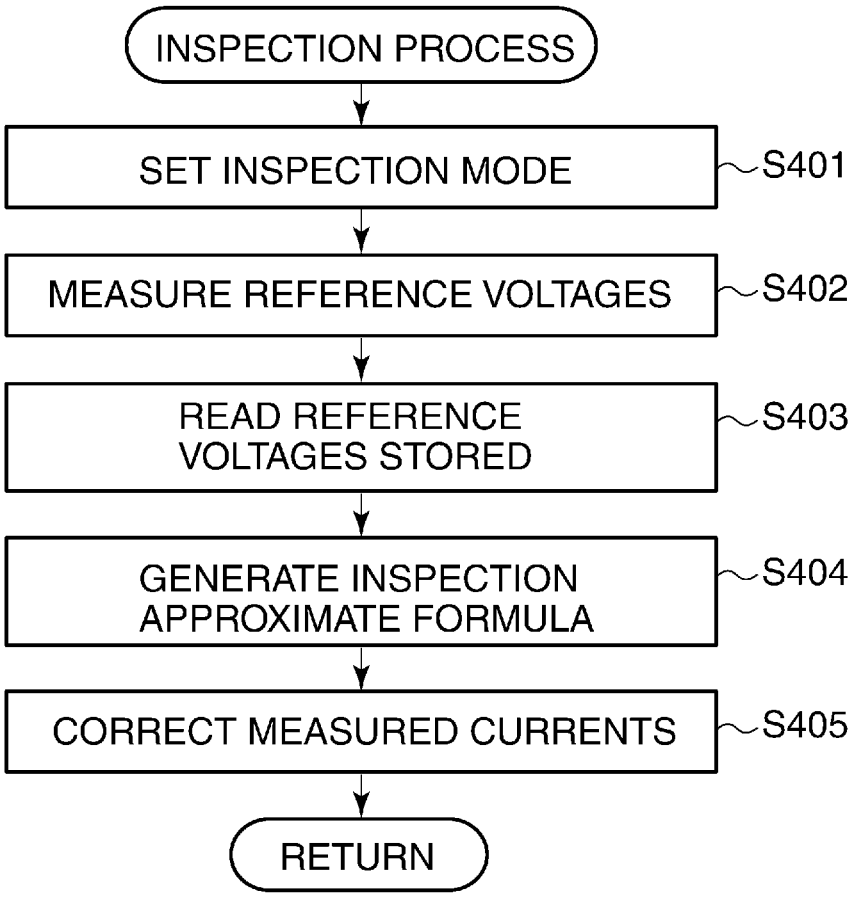
FIG. 13B is a flowchart showing procedures of an inspection process executed in step S400 in FIG. 13A.

FIG. 13B is a flowchart showing procedures of the inspection process executed in the step S400 in FIG. 13A.

The inspection process in FIG. 13B is performed when the laser control unit 52 drives the laser driving unit 11 with a control signal.

As shown in FIG. 13B, the APC-H 32, the APC-M 34, and the APC-L 36 are set to the inspection mode with the inspection signal CAL (step S401). Then, the gain correction unit 53 measures the reference voltages output from the ADC 54 while switching the connection of the SW 51, and the inspection mode is released (step S402).

Next, the reference voltages input into the ADC 54 that were stored in the step S303 in FIG. 12B are read and are output to the gain correction unit 53 (step S403). Then, the gain correction unit 53 generates the following inspection approximate formula (5) (step S404) by associating (for example, plotting on a graph as shown in FIG. 14) the reference voltages input into the ADC 54 with the reference voltages output from the ADC 54 that were measured in the step S402.

Figure 14:
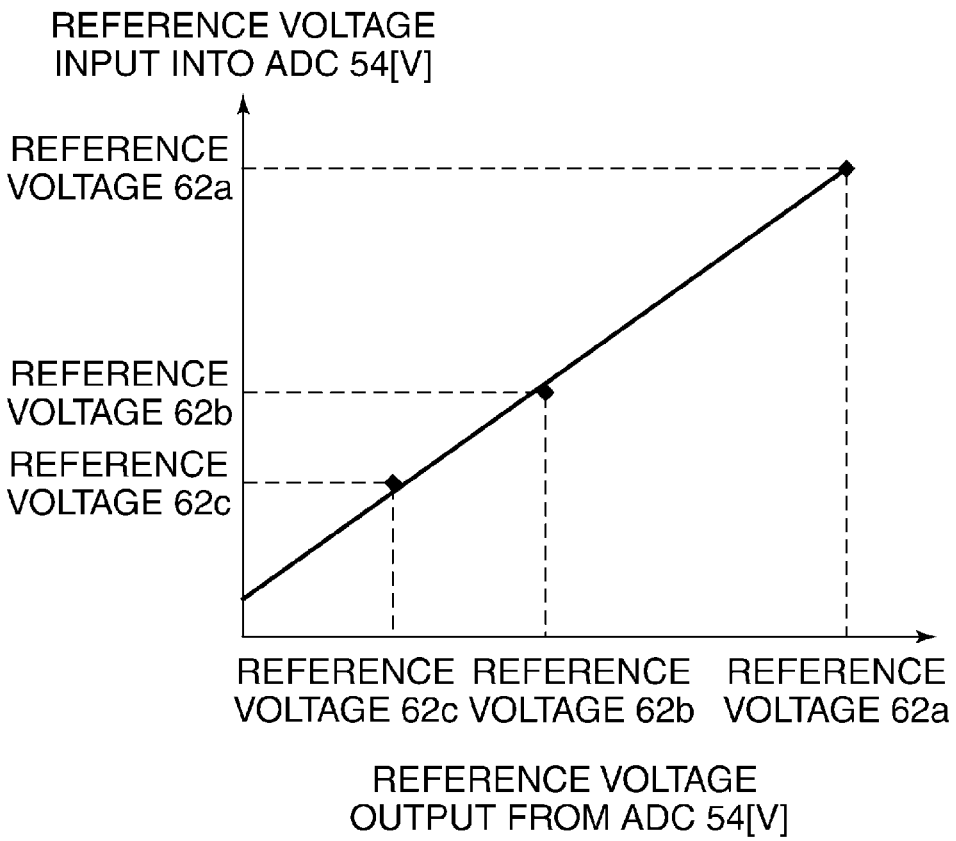
FIG. 14 is a graph showing a relationship between input voltage and output voltage of an AD converter used to generate an inspection approximate formula in step S404 in FIG. 13B.

In the graph in FIG. 14, a horizontal axis indicates the reference voltage output from the ADC 54, and a vertical axis indicates the reference voltage input into the ADC 54.

A linear approximate characteristic is found by associating the reference voltages input into the ADC 54 with the reference voltages output from the ADC 54 in the second embodiment. Then, since the reference voltages correspond to the driving currents, the reference voltages are converted into the driving currents using the found approximate characteristic, and the following inspection approximate formula (5) is generated using correction coefficients g and h.

$$(\text{Post-correction driving current})=g\cdot(\text{Driving current before correction})+h \quad (5)$$

It should be noted that the reference voltages input into the ADC 54 that were stored in the step S303 are correspond to the values under the condition of Ta=25° C. because they are premised on the steps S101 through S106. On the other hand, the reference voltages output from the ADC 54 that were measured in the step S402 correspond to the values under the condition of Ta=50° C. because they are premised on the steps S201 through S203. However, since the reference voltages are hardly affected by a temperature change, the reliability of the inspection approximate formula (5) does not deteriorate, even if the inspection approximate formula (5) is generated from the reference voltages in the different temperatures.

Referring back to FIG. 13B, the driving currents ($I_H'$, $I_M'$, and $I_L'$) measured at the step S203 in FIG. 13A are corrected using the inspection approximate formula (5) generated in the step S404 (step S405), the procedures in and after the step S204 are performed, and this process is finished.

According to the inspection process from FIG. 12A to FIG. 13B, the inspection approximate formula (5) is generated on the basis of the reference voltages input into the ADC 54 and the reference voltages output from the ADC 54 (step S404). And then, the driving currents ($I_H'$, $I_M'$, and $I_L'$) measured in the step S203 in FIG. 13A are corrected using the generated inspection approximate formula (5) concerned. This removes influence due to a change of temperature around the ADC 54 from a driving current, which enables to correctly obtain a desired light amount by calculating a gain control value from a light-amount setting value corresponding to the desired light amount using the approximate formula (3).

It should be noted that the gain correction unit 53 and the ADC 54 may be arranged in the laser driving unit 11 in the above-mentioned embodiments.

Next, an image processing apparatus and a control method therefor according to a third embodiment of the present invention will be described.

Since the third embodiment is basically identical to the first embodiment in its configurations and actions, descriptions about the identical configurations and actions are omitted, and configurations and actions that are different from that in the first embodiment will be described in detail.

Figure 15:
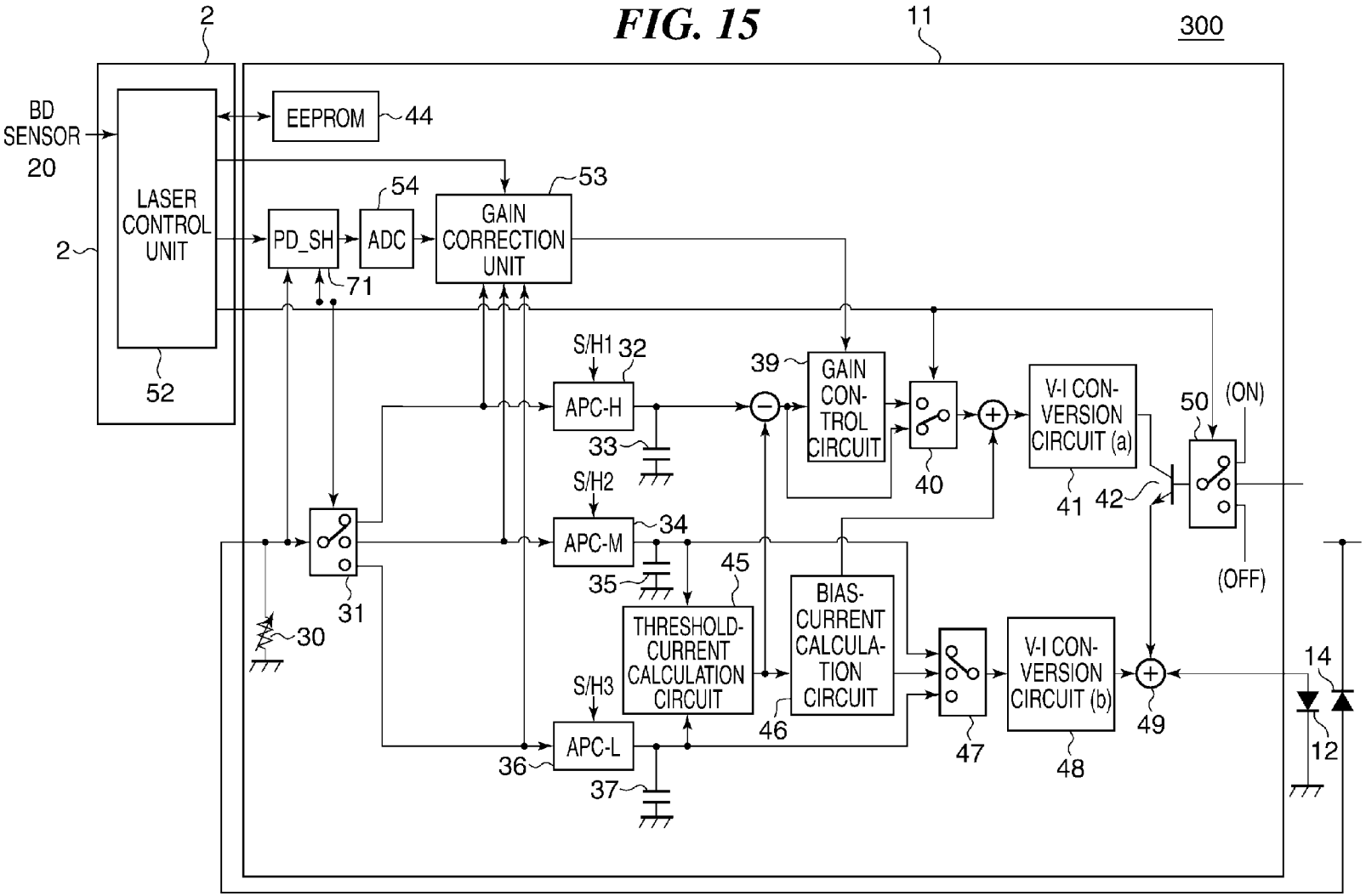
FIG. 15 is a block diagram schematically showing a configuration of a laser control system in an image forming apparatus according to a third embodiment of the present invention.

FIG. 15 is a block diagram schematically showing a configuration of a laser control system 300 in the image forming apparatus 1 according to the third embodiment of the present invention. It should be noted that only different configurations from the laser control system 300 in FIG. 3A will be described in detail.

As shown in FIG. 15, the ADC 54 and the gain correction unit 53 are disposed in the laser driving unit 11, and a PD sample hold circuit (hereinafter referred to as "PD_SH") 71 is also disposed in the laser driving unit 11. The PD_SH 71, the ADC 54, and the gain correction unit 53 are connected in series, and the PD_SH 71 is connected to the laser control unit 52 of the image control unit 2.

Figure 16:
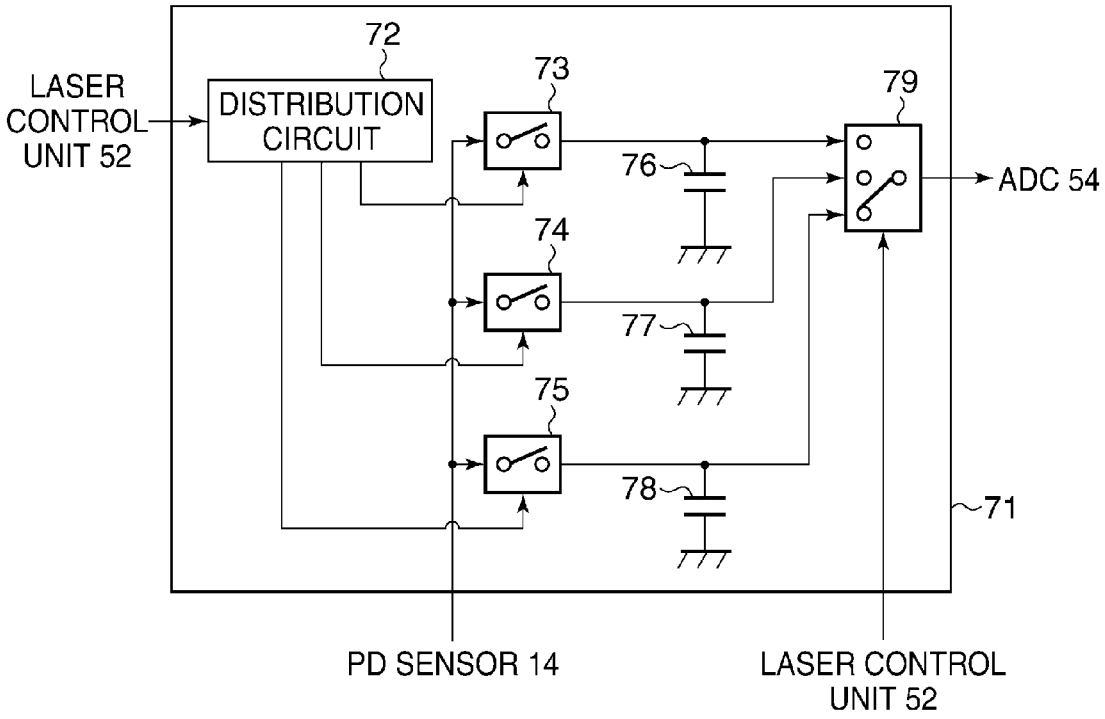
FIG. 16 is a block diagram schematically showing a configuration of a PD_SH shown in FIG. 15.

FIG. 16 is a block diagram schematically showing a configuration of the PD_SH 71 shown in FIG. 15.

As shown in FIG. 16, the PD_SH 71 includes a distribution circuit 72, switches 73, 74, 75, and 79 (hereinafter referred to as "SW 73", "SW 74", "SW 75", and "SW 79"), and capacitors 76, 77, and 78. The SW 79 has three input terminals. The output terminal of the laser control unit 52 is connected to the input terminal of the distribution circuit 72. The output terminal of the PD sensor 14 is connected to the input terminals of the SWs 73, 74, and 75 that are controlled by an output signal from the distribution circuit 72. The output terminals of the SWs 73, 74, and 75 are respectively connected to the capacitors 76, 77, and 78, and are respectively connected to the three input terminals of the SW 79 that is controlled with a control signal from the laser control unit 52. The output terminal of the SW 79 is connected to the ADC 54.

The PD_SH 71 controls the SWs 73, 74, and 75 independently by outputting the PD sample signals to the SWs 73, 74, and 75 at different timings. The PD_SH 71 charges and discharges the capacitors 76, 77, and 78 on the basis of signals output from the PD sensor 14, and transfers signals output from the PD sensor 14 to the SW 79. The SW 79 selects one of the transferred signals according to the control signal from the laser control unit 52, and only the selected signal is output as an output signal of the PD_SH 71.

Figure 17:
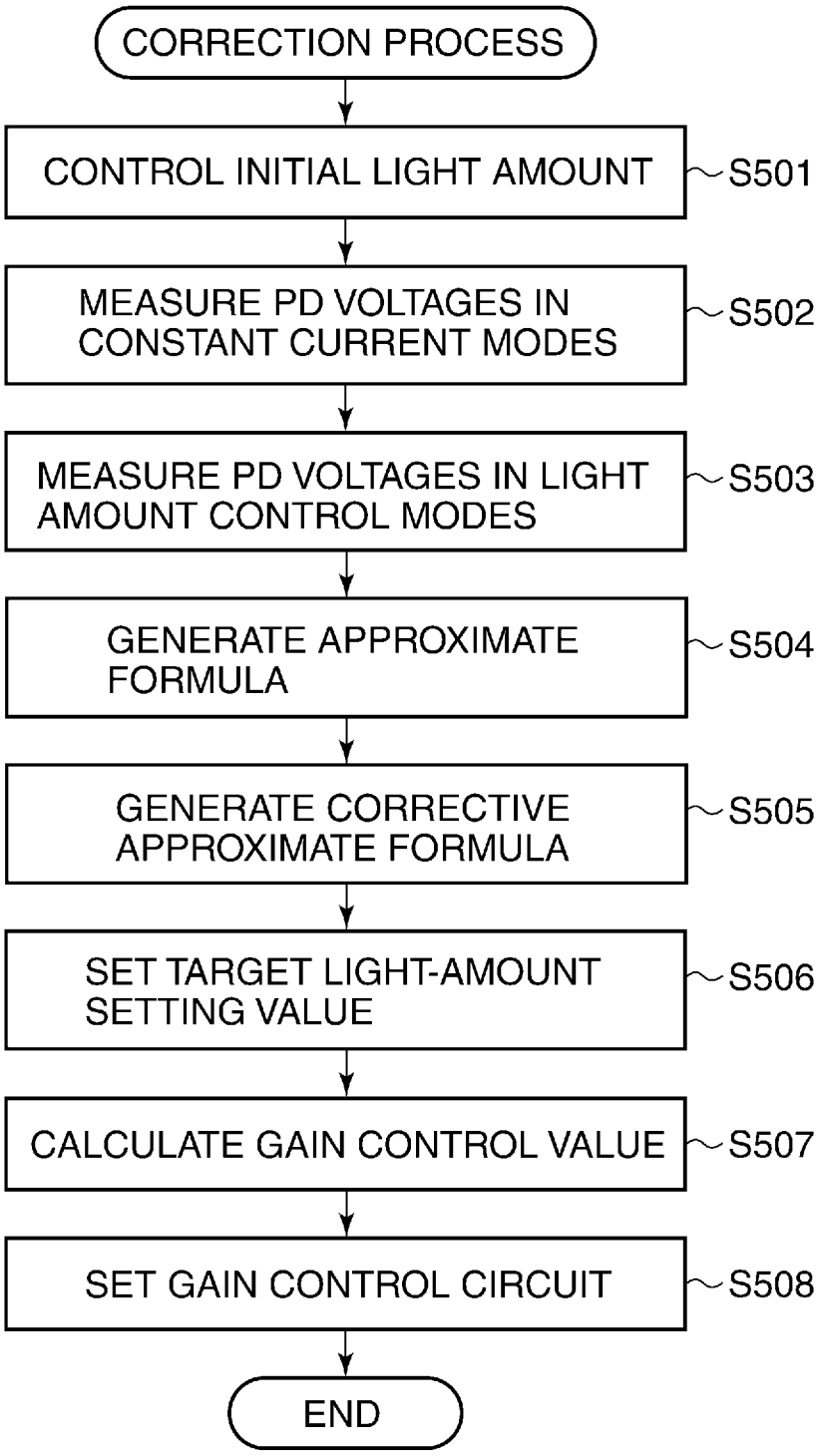
FIG. 17 is a flowchart showing procedures of a correction process according to the third embodiment.

FIG. 17 is a flowchart showing procedures of a correction process according to the third embodiment.

The correction process in FIG. 17 is executed because the laser control unit 52 drives the laser driving unit 11 with a control signal after the optical scanning devices 5*a*, 5*b*, 5*c*, and 5*d* are installed into the image forming apparatus 1.

In the correction process in FIG. 17, the light from the semiconductor laser 12 is received by the PD sensor 14, a corrective approximate formula (7) mentioned later is generated on the basis of the received light amount, and the gain control value is corrected using the corrective approximate formula (7). Accordingly, the gain control value is corrected with higher accuracy in the correction process in FIG. 17 as compared with the correction process in FIG. 8 that uses the corrective approximate formula (4) generated on the basis of the driving current.

Figure 18A:
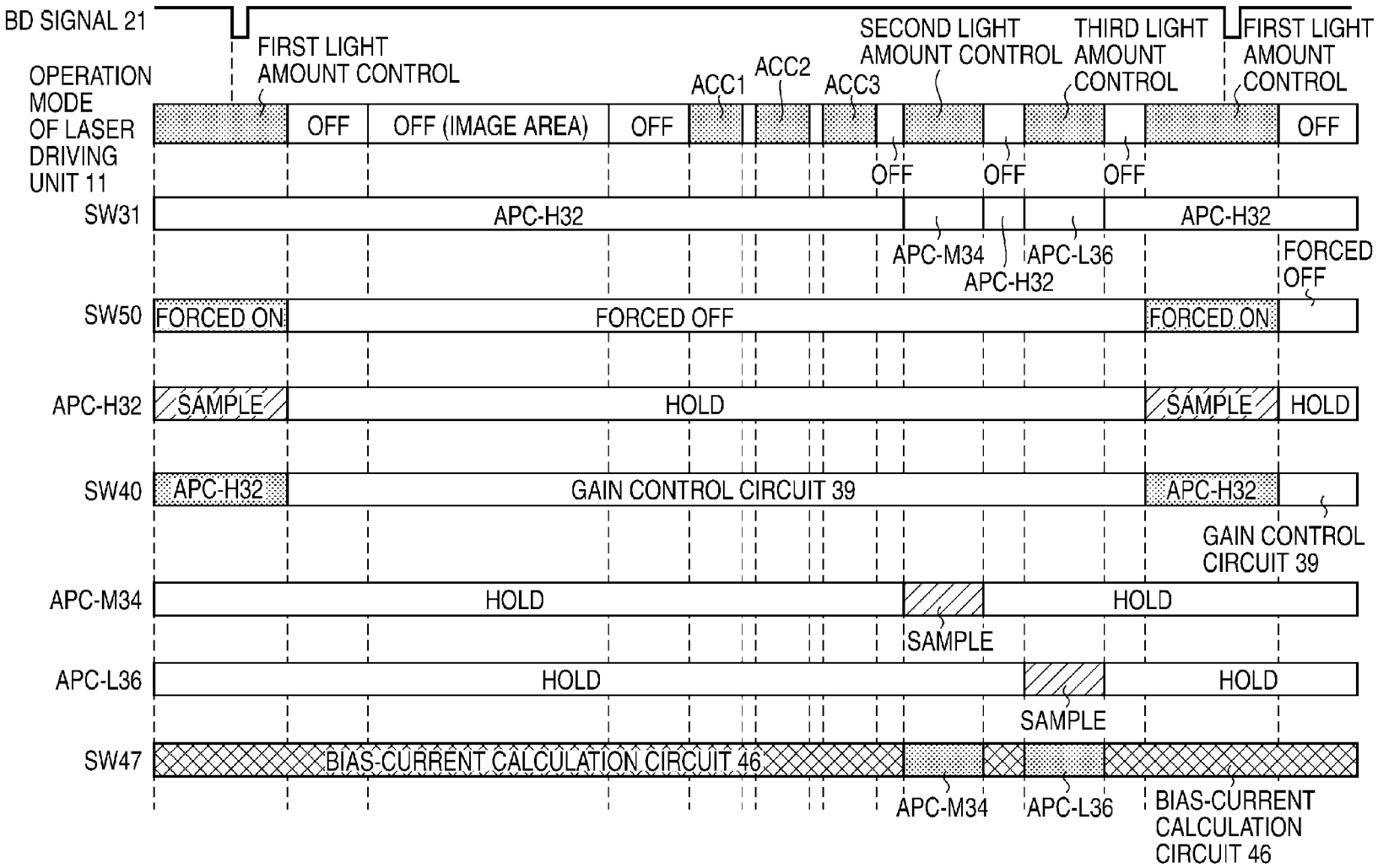
FIG. 18A and FIG. 18B are parts of a timing chart showing states of members included in a laser driving unit shown in FIG. 15 in each control mode.
Figure 18B:
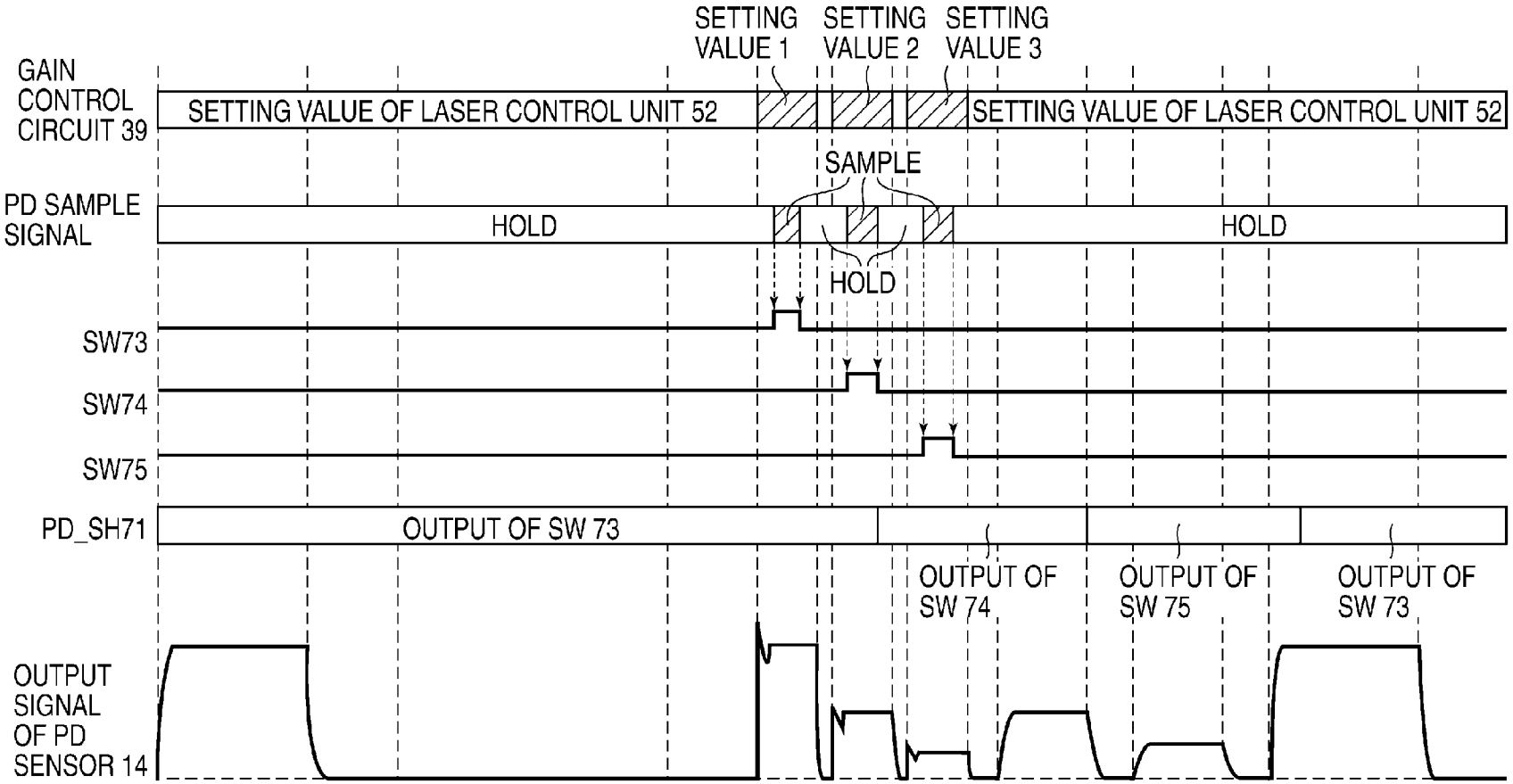

In FIG. 17, the laser driving unit 11 is set in the first light-amount control mode first, and an initial light amount setting is performed (step S501). Furthermore, the laser driving unit 11 is set in a first constant current mode (ACC1), a second constant current mode (ACC2), and a third constant current mode (ACC3), which are shown in FIG. 18A and FIG. 18B, in turn, and the semiconductor laser 12 emits light in each of the constant current modes. The PD_SH 71 measures voltage of the PD sensor 14 (hereinafter referred to as "PD voltage") that receives the light emitted from the semiconductor laser 12 (step S502). It should be noted that FIG. 18A shows one part of a timing chart and FIG. 18B shows the other part of the timing chart.

In the ACC1, the light amount equivalent to that in the first light-amount control mode is set, and the semiconductor laser 12 emits light under the control of the APC-H 32. In the ACC2, the light amount is set at 50% of the light amount in the ACC1. That is, the gain control circuit 39 sets the gain control value at 50%, and the semiconductor laser 12 emits light under the control of the APC-H 32 of which the gain is adjusted by the gain control value of 50%. In the ACC3, the light amount is set at 25% of the light amount in the ACC1. That is, the gain control circuit 39 sets the gain control value at 25%, and the semiconductor laser 12 emits light under the control of the APC-H 32 of which the gain is adjusted by the gain control value of 25%.

Next, the laser driving unit 11 is set in the first light-amount control mode, and the gain correction unit 53 measures a PD voltage. Then, the laser driving unit 11 is set in the second light-amount control mode and the third light-amount control mode in turn, and the gain correction unit 53 measures a PD voltage in the second light-amount control mode and a PD voltage in the third light-amount control mode (step S503).

Next, the following approximate formula (6) that finds a gain control value from a light-amount setting value using coefficients i, j, and k is generated on the basis of the PD voltages (i.e., light amounts) measured in the step S503 (step S504).

Specifically, light-amount setting values in the second light-amount control mode and the third light-amount control mode are calculated on the presumption that the light amount measured in the first light-amount control mode is the light-amount setting value of "1.00". The calculated light-amount setting values are equivalent to values obtained by normalizing the light amounts measured in the second and third light-amount control modes by the light amount measured in the first light-amount control mode. The following approximate formula (6) is generated from the interrelation between the light-amount setting values and the gain control values in the respective modes.

$$(\text{Gain control value}) = i\cdot(\text{Light-amount setting value})^2 + j\cdot(\text{Light-amount setting value}) + k \quad (3)$$

Accordingly, since the gain control value is calculated from the light-amount setting value corresponding to the desired light amount using the approximate formula (6), and the light amount of the semiconductor laser 12 is controlled using the calculated gain control value, the desired light amount is obtained.

Next, a corrective approximate formula (7) mentioned later that corrects the gain control value calculated by the above-mentioned approximate formula (6) on the basis of the PD voltages measured in the steps S502 and S503 (step S505).

As mentioned above, the light amount that is 50% of the light amount in the first light-amount control mode is set in the second light-amount control mode, and the light amount that is 25% of the light amount in the first light-amount control mode is set in the third light-amount control mode. On the other hand, the gain control value of 100% is set in the ACC1, the gain control value of 50% is set in the ACC2, and the gain control value of 25% is set in the ACC3. That is, the ACC1 corresponds to the first light-amount control mode, the ACC2 corresponds to the second light-amount control mode, and the ACC3 corresponds to the third light-amount control mode. Accordingly, the PD voltage in the first light-amount control mode, the PD voltage in the second light-amount control mode, and the PD voltage of a third light-amount control mode are preferably equivalent to the PD voltage in the ACC1, the PD voltage in the ACC2, and the PD voltage in the ACC3, respectively.

Figure 19:
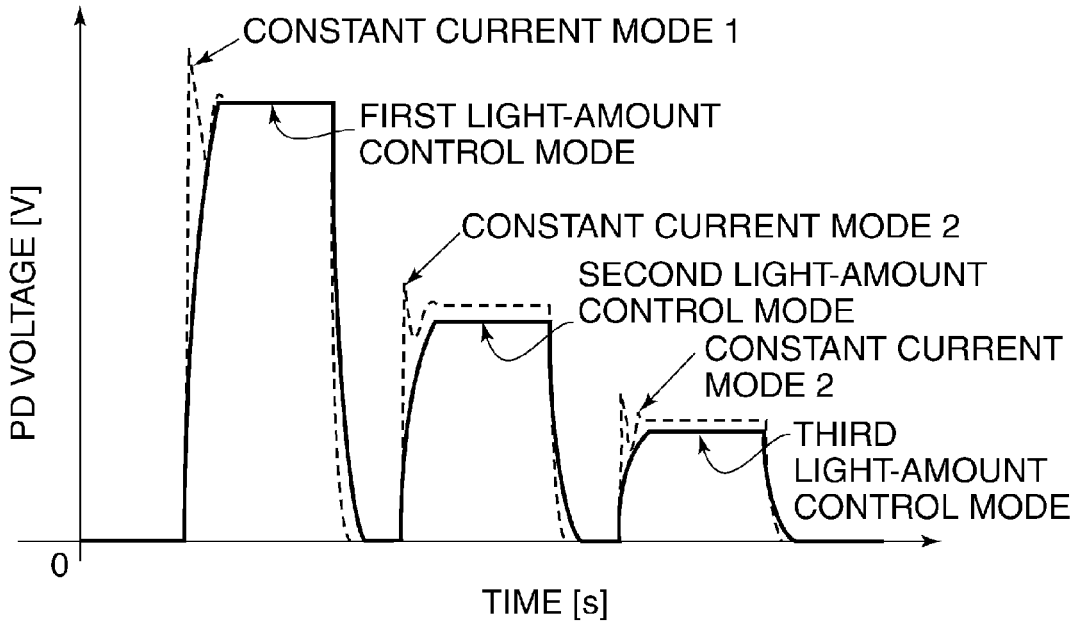
FIG. 19 is a graph showing comparisons between PD voltages in light-amount control modes in the correction process in FIG. 17 and PD voltages in constant current modes.

Since the output signal of the PD 14 (PD voltage) is feedback-controlled on the basis of the reference voltages in the first through third light-amount control modes, a constant output signal (PD voltage) of which waveform is shaped is obtained. On the other hand, since the output signal of the PD 14 (PD voltage) is not feedback-controlled in the ACC1 through ACC3 and the light amount characteristic of the semiconductor laser 12 is output as-is from the PD 14, an output signal (PD voltage) of which waveform is not shaped is obtained. Accordingly, as shown in FIG. 19, the PD voltages in the first through third light-amount control modes are not equivalent to the PD voltages in the ACC1 through ACC3, respectively. The above-mentioned approximate formula (6) is generated on the basis of the light amounts measured in the first through third light-amount control modes. Therefore, even if the gain control value corresponding to the desired light amount is calculated using the above-mentioned approximate formula (6) in the ACC1 through ACC3 and the light amount of the semiconductor laser 12 is controlled using the calculated gain control value, the desired light amount may not be obtained.

Consequently, the following corrective approximate formula (7), which cancels deviations among the PD voltages in the ACC1, ACC2, and ACC3, and deviations among the PD voltages in the first, second, and third light-amount control modes, is generated in the third embodiment.

Figure 20:
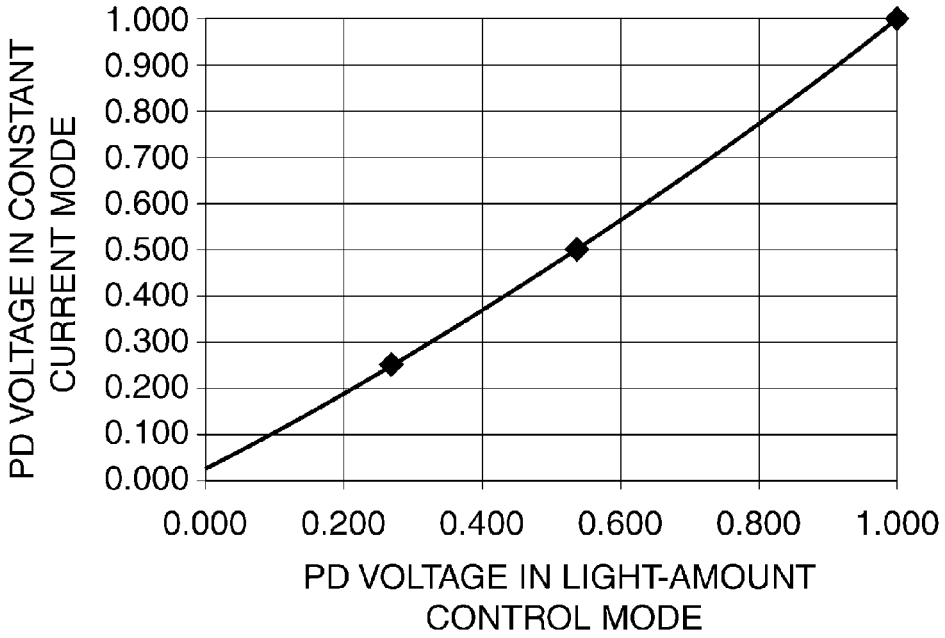
FIG. 20 is a graph showing relationships between the PD voltages in the light-amount control modes and the PD voltages in the constant current modes, which are used to generate a corrective approximate formula in step S505 in FIG. 17.
Figure 21:
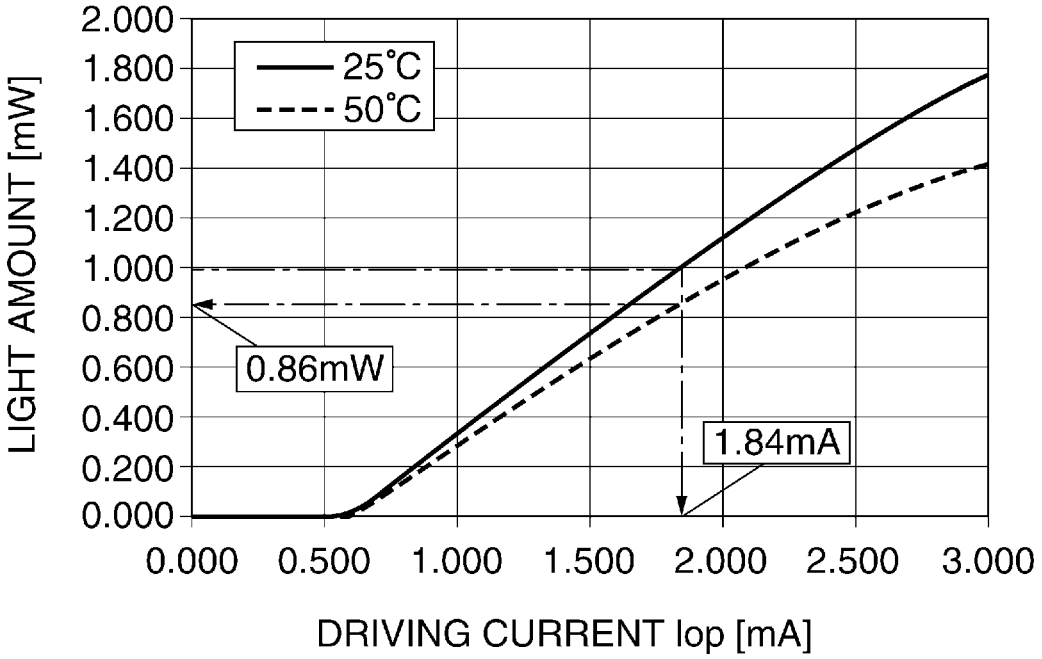
FIG. 21 is a graph showing examples of driving-current/light-amount characteristics of a semiconductor laser.

Specifically, the PD voltages in the second and third light-amount control modes are normalized by the PD voltage in the first light-amount control mode. The PD voltages in the ACC2 and ACC3 are normalized by the PD voltage in the ACC1. After that, the normalized values are plotted in a graph as shown in FIG. 20. In the third embodiment, the relation between the PD voltages in the first, second, and third light-amount control modes and the PD voltages in the ACC1, ACC2, and ACC3 is expressed by a quadratic function, as shown in FIG. 20. Moreover, since the gain control value corresponds to the PD voltage, the following corrective approximate formula (7) is generable using coefficients p, m, and n.

$$(\text{Post-correction gain control value})=p\cdot(\text{Gain control value})^2+m\cdot(\text{Gain control value})+n \quad (7)$$

Next a target light-amount setting value is set (step S506). A post-correction gain control value corresponding to the target light-amount setting value is calculated using the approximate formula (6) generated in the step S504 and the corrective approximate formula (7) generated in the step S505 (step S507, the calculation unit). The gain control value calculated in the step S507 is set in the gain control circuit 39 (step S508), and this process is finished.

According to the process in FIG. 17, the corrective approximate formula (7) is generated on the basis of the PD voltages in the first, second, and third light-amount control modes and the PD voltages in the ACC1, ACC2, and ACC3. Then, the gain control value, which is obtained from the light-amount setting value using the approximate formula (6), is corrected using the corrective approximate formula (7). Accordingly, the desired light amount is obtained in the ACC1, ACC2, and ACC3 by reducing an influence of deviations of the PD voltages in the first, second, and third light-amount control modes from the PD voltages in the ACC1, ACC2, and ACC3.

Although the present invention is described using the embodiments mentioned above, the present invention is not limited to the embodiments mentioned above.

For example, the data about the approximate formula of the post-correction gain control value may be stored in the EEPROM 44 in the embodiments mentioned above.

Although the reference voltage is measured in the inspection process in the embodiments mentioned above, another signal may be measured.

Although the voltage Vch1 is controlled using the capacitor 33 in the embodiments mentioned above, the voltage Vch1 may be controlled using a storage unit (not shown) that stores data (digital data) and a D/A converter (not shown) that outputs a voltage on the basis of the stored data.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107268, filed May 23, 2014, which is hereby incorporated by reference herein in its entirety.

What is claimed is:

1. An image forming apparatus comprising:

a light source configured to emit a light beam of which light amount corresponds to a driving current supplied;

a photosensitive member configured to be exposed to the light beam emitted from said light source;

a light receiving element configured to receive the light beam emitted from said light source;

a voltage setting unit in which a voltage for prescribing the driving current is set;

a voltage control unit configured to control the voltage set in said voltage setting unit so that the light amount of the light beam received by said light receiving element becomes a target light amount;

a determination unit configured to determine a correction parameter for correcting the voltage set in said voltage setting unit based on at least the voltage set in said voltage setting unit;

a correction unit configured to correct the voltage set in said voltage setting unit with the correction parameter determined by said determination unit; and a current supply unit configured to supply the driving current corresponding to the voltage corrected by said correction unit to said light source based on image data.

2. The image forming apparatus according to claim 1, wherein said determination unit determines the correction parameter based on information about a state of the image forming apparatus and the voltage set in said voltage setting unit.

3. The image forming apparatus according to claim 1, further comprising:

a development device configured to develop an electrostatic latent image, which is formed on said photosensitive member by exposing to the light beam, using toner;

a detection unit configured to detect density of a density-detection toner image that is a toner image developed by said development device, wherein said determination unit determines the correction parameter based on the density of the density-detection toner image detected by said detection unit and the voltage set in said voltage setting unit.

4. The image forming apparatus according to claim 3, further comprising:

a deflection unit configured to deflect the light beam so that the light beam emitted from said light source scans said photosensitive member to form an electrostatic latent image on the photosensitive member;

a transfer unit configured to transfer a toner image, which is formed by said development unit by developing the electrostatic latent image, to a recording medium;

a storage unit configured to store a first parameter generated based on a detection result of the density-detection toner image formed whenever at least one recording medium is used; and a generation unit configured to generate a second parameter based on the voltage set in said voltage setting unit at a frequency higher than a frequency of formation of the density-detection toner image, wherein said determination unit determines the correction parameter based on the first parameter stored in said storage unit and the second parameter generated by said generation unit.

5. The image forming apparatus according to claim 3, wherein said detection unit comprises a photo sensor that irradiates the density-detection toner image on said photosensitive member with light and detects the density of the density-detection toner image based on a detection result of reflected light from the toner image.

6. The image forming apparatus according to claim 1, wherein said voltage setting unit comprises a capacitor, and a voltage of the capacitor is controlled so that a light amount of a light beam received with said light receiving element becomes the target light amount, wherein said determination unit determines gain as the correction parameter based on the voltage of the capacitor, and wherein said correction unit corrects the voltage of the capacitor with the gain determined by said determination unit.

7. The image forming apparatus according to claim 1, wherein said voltage setting unit includes a storage unit that stores digital data and a D/A converter that outputs a voltage based on the digital data stored in the storage unit, wherein said voltage control unit stores the digital data into the storage unit so that the light amount of the light beam received with said light receiving element becomes the target light amount, wherein said determination unit determines gain as the correction parameter based on the state of the image forming apparatus and the voltage output from the D/A converter, and wherein said current unit corrects the voltage output from the D/A converter with the gain determined by said determination unit.

8. The image forming apparatus according to claim 1, wherein said voltage control unit comprises a reference voltage output unit configured to output a reference voltage corresponding to the target light amount, and a comparator configured to compare a voltage of an electrical signal that is output from said light receiving element and corresponds to the light amount of the light beam with the reference voltage, and to output a signal for controlling the voltage of said voltage setting unit based on a comparison result.

9. A method of controlling an image forming apparatus, the method comprising:

emitting a light beam of which light amount corresponds to a supplied driving current;

exposing a photosensitive member to the emitted light beam;

receiving the emitted light beam at a light receiving element;

setting a voltage for prescribing the driving current;

controlling the set voltage so that the light amount of the light beam received by the light receiving element becomes a target light amount;

determining a correction parameter for correcting the set voltage based on at least the set voltage;

correcting the set voltage with the determined correction parameter; and supplying the driving current corresponding to the corrected voltage to the light source based on image data.

* * * * *